US005905415A

United States Patent [19]

Fujishiro et al.

[11] Patent Number: 5,905,415

[45] Date of Patent: May 18, 1999

[54] DISTRIBUTED CONSTANT LINE COUPLING WITH A GAP DOMAIN

[75] Inventors: Hiroki Fujishiro; Kiyoshi Nagai, both of Tokyo, Japan

[73] Assignee: Oki Electric Industry Co., Ltd., Tokyo, Japan

[21] Appl. No.: 08/877,509

[22] Filed: Jun. 17, 1997

[30] Foreign Application Priority Data

Jun. 21, 1996 [JP] Japan ..... 96-162153

[51] Int. Cl.[6] ..... H01P 5/00

[52] U.S. Cl. ..... 333/116; 333/238

[58] Field of Search ..... 333/116, 204, 333/205, 238

[56] References Cited

FOREIGN PATENT DOCUMENTS 55-85102 6/1990 Japan ..... 333/204

OTHER PUBLICATIONS

Von Wolfram Schminke, "Dielectric Loaded Cavity Resonators with Stripline Coupling", Frequenz, 33 (1979) 2, pp. 37–39.

Microwave Semiconductor Circuits, Figure 6.13, pp. 139 by The Nikkan Kogyo Shimbun Ltd., 1993.

*Primary Examiner*—Benny Lee
*Assistant Examiner*—Justin P. Bettendorf
*Attorney, Agent, or Firm*—Rabin & Champagne P.C.

[57] ABSTRACT

A coupling between distributed constant lines which are provided on an individual chip is made so that deterioration in their characteristics may not be caused by an inductance. A first microstrip line 42 and a second microstrip line 44 are provided on an underlayer metal plate 10, separately from each other with a gap domain 60 interposed therebetween. The first microstrip line 42 is composed of a first grounding conductor 12, a first dielectric substrate 14, and a first conductor line 46 which are stacked one after another. The second microstrip line 44 is composed of a second grounding conductor 13, a second dielectric substrate 16, and a second conductor line 48 which are stacked one after another. The first conductor line 46 is provided with a first gap 56 extending in the direction q perpendicular to the arrangement direction p, and the second conductor line 48 is provided with a second gap 58 extending in the direction q perpendicular to the arrangement direction p. When assuming that the wavelength corresponding to the central frequency of a desired frequency band is λ, the distance between the first gap 56 and the gap domain 60 along the arrangement direction p and the distance between the second gap 58 and the gap domain 60 along the arrangement direction p are, respectively, set at m λ/2 (where m is an integer).

30 Claims, 18 Drawing Sheets

PRIOR ART

DISTRIBUTED CONSTANT LINE COUPLING WITH A GAP DOMAIN

BACKGROUND OF THE INVENTION

1. Field of the Invention

The present invention relates to a microwave circuit, and a method for coupling distributed constant lines with each other in case of integrating plural chips having provided therein microwave circuits, particularly, distributed constant circuits.

2. Description of the Related Art

A microwave circuit is a so-called distributed constant circuit in which distributed constant lines are used for guiding a microwave signal. This specification assumes as a distributed constant circuit a circuit composed of a conductor line, a dielectric substrate, and a grounding conductor. In this specification, a distributed constant circuit is sometimes used in a sense of a microwave circuit. Up to now, in case of integrating plural distributed lines to make a microwave circuit, the respective distributed constant lines have been coupled with each other by bonding wires, ribbons, and the like to the lines (reference: Microwave Semiconductor Circuits, FIG. 6.13, pp.139, issued by The Nikkan Kogyo Shimbun Ltd., in 1993).

FIG. 18 is a perspective view showing an example of a conventional construction disclosed in this reference, and in this perspective view there is shown a conventional coupling between a first distributed constant line 70 and a second distributed line 72. The first distributed constant line 70 is composed of a first grounding conductor 12, a first dielectric substrate 14, and a first conductor line 46 which are stacked one after another. The second distributed constant line 72 is composed of a second grounding conductor 13, a second dielectric substrate 16, and a second conductor line 48 which are stacked one after another. In FIG. 18, to simplify the figure, only distributed constant lines are shown and the other circuit elements usually provided are omitted even if they are provided on these dielectric substrates 14 and 16. In the construction shown in FIG. 18, therefore, the coupling between the first distributed constant line 70 and the second distributed constant line 72 has used a mechanical bridging member, for example, a wire 26 for coupling the first conductor line 46 and the second conductor line 48 with each other and an underlayer metal plate 10 for coupling the first grounding conductor 12 and the second grounding conductor 13 with each other.

As described with reference to FIG. 18, however, when the first and second distributed constant lines 70 and 72 are provided on the underlayer metal plate (grounding metal plate) 10, a gap of at least 0.1 to 0.2 mm or so comes to be generated between the distributed constant lines 70 and 72 (between the dielectric substrates 14 and 16), depending upon the dimensional accuracy of these distributed constant lines (mainly the dimensional accuracy of the dielectric substrates) or their assembling accuracy (accuracy related to positioning or processing). Accordingly, for example, in case of coupling the first and second conductor lines 46 and 48 with each other by bonding the wire 26, respectively, with them, an inductance of at least 0.1 to 0.2 nH or so results in being inserted in series between the first and second conductor lines 46 and 48.

As a result, an impedance mismatching between the first and second conductor lines 46 and 48 (namely, an impedance mismatching between the microwave circuits which are respectively composed of the first and second distributed constant lines 70 and 72) comes to be generated, and there has been a problem that characteristics (signal propagation characteristics such as gain, voltage standing wave ratio (VSWR), and the like) of the microwave circuit composed of both the first and second distributed constant lines 70 and 72, are deteriorated. And the higher the operating frequency is, the poorer the obtained characteristics have been.

Accordingly, it is an object of the present invention is to provide a method for coupling distributed constant lines with each other without deteriorating their signal propagation characteristics.

Another object is to provide a microwave circuit in which distributed constant lines are coupled with each other while keeping their good signal propagation characteristics.

SUMMARY OF THE INVENTION

In accordance to a first aspect of the present invention, there is provided a method for coupling an individual first distributed constant line comprising a first conductor line, a first dielectric substrate and a first grounding conductor, and an individual second distributed line comprising a second conductor line, a second dielectric substrate and a second grounding conductor, which are provided on a common underlayer metal plate and are coupled with each other. This coupling is made so that said first and second grounding conductors may be electrically connected with each other through the common underlayer metal plate. And this coupling couples electromagnetically said first and second distributed constant lines with each other arranging said first and second conductor lines in collinear alignment with a gap domain interposed between them.

In such a way, by arranging the first and second conductor lines in collinear alignment, separated from each other with a gap interposed between them, in cooperation with the underlayer metal plate, it is possible to make an electromagnetic coupling, namely, a distributed coupling between the first and second distributed constant lines. Accordingly, since it is not necessary to use a mechanical bridging member such as a wire or the like in order to couple distributed constant lines with each other as required in the prior art, the coupling can be obtained without inducing inductance between the distributed constant lines, and thus it is possible to attain a better signal propagation characteristic in comparison with the prior art.

And according to a preferred embodiment of a method coupling distributed constant lines of the present invention, it is preferable to make the following construction. The first line position of the first conductor line is made open (nonconductive), the second line position of the second conductor line is made open, and the gap domain is made open. At this time, a middle position between the first line position and the gap domain, and a middle position between the second position and the gap domain are short-circuited (conductive), respectively. Assuming that the wavelength corresponding to the central frequency of a desired frequency band is $\lambda$, the distance between the first line position and the gap domain and the distance between the second line position and the gap domain are respectively set at $m\lambda/2$ (where m is an integer).

Here, "open" means a state where conductors are disconnected from each other (not present at the designated position) so that current cannot flow. And "short-circuited" means a state where a low-resistance connection (for example, connection by a conductor) is made between circuits or lines. In such a way, by forming the first and second line positions at specified positions, in cooperation with these line positions and the gap domain, the middle position between the first line position and the gap domain and the middle position between the second line position and the gap domain can be short-circuited (conductive), respectively. Accordingly, a microwave signal guided through the distributed constant lines excites a standing wave which has an antinode at each of the first line position, the second line position, and the gap domain, and has a node at each of the middle positions and the microwave is resonated between these first and second line positions. Therefore, the first and second distributed constant lines can be coupled with each other at high frequency, and since it is not necessary to use a mechanical bridging member such as a wire or the like in order to couple distributed constant lines with each other as required in the prior art, the coupling can be obtained without inducing inductance between the distributed constant lines and thus it is possible to attain a better signal propagation characteristic than with the prior art.

According to another preferred embodiment of a distributed constant lines coupling method of the present invention, it is preferable also to make the following construction. The first line position of the first conductor line is made short-circuited (conductive), the second line position of the second conductor line is set as a short-circuited (conductive) point, and the gap domain is set as an opened point. At this time, assuming that the wavelength corresponding to the central frequency of a desired frequency band is $\lambda$, the distance between the first line position and the gap domain and the distance between the second line position and the gap domain are respectively set at $n\lambda/4$ (where n is an odd number).

In such a way, by forming the first and second line positions at specified positions, a microwave signal guided through the distributed constant lines excites a standing wave which has a node at each of the first line position and the second line position, and has an antinode at the gap domain, and is resonated between the first and second line positions. Accordingly, the first and second distributed constant lines can be coupled with each other at high frequency. Therefore, since it is not necessary to use a mechanical bridging member such as a wire or the like in order to couple distributed constant lines with each other as required in the prior art, the coupling can be obtained without inducing inductance between the distributed constant lines, and thus it is possible to attain a better signal propagation characteristic than with the prior art.

According to a third preferred embodiment of a distributed constant lines coupling method of the present invention, it is preferable to compose the distributed constant line as a microstrip line.

A microstrip line is a signal transmission line in which the characteristic impedance formed by a dielectric (a dielectric substrate) between a grounding surface as a grounding conductor and a wiring surface as a conductor line has been regulated. The characteristic impedance depends on the dielectric constant and thickness of the dielectric, and the width and thickness of the wiring. In a high-frequency circuit whose frequency is equal to or higher than the microwave band, an arbitrary impedance can be attained by changing the line in width, and a two-dimensional waveguide such as a microstrip line is more often used as a distributed constant circuit, because the waveguide is smaller in size, lighter in weight, simpler in construction, and easier to manufacture than with a three-dimensional waveguide such as a coaxial cable and an ordinary waveguide.

Accordingly, by using a microstrip line as a distributed constant line, a microwave circuit becomes easy to integrate, and results in having advantages that it has a broad-band performance, its circuit elements, and is little influenced by parasitic elements are easy to mount.

According to another aspect of the present invention, there is provided a microwave circuit that comprises a first distributed constant line and a second distributed constant line coupled with each other. The individual first distributed constant line comprises a first dielectric substrate, a first grounding conductor provided on the lower surface of the first dielectric substrate, and a first conductor line in parallel with the lower surface provided on the first dielectric substrate. The individual second distributed constant line comprises a second dielectric substrate, a second grounding conductor provided on the lower surface of the second dielectric substrate, and a second conductor line in parallel with the lower surface provided on the second dielectric substrate. The first and second distributed constant lines are arranged on an underlayer metal plate, so that the first grounding conductor and the second grounding conductor may be electrically coupled with each other by the common underlayer metal plate. The first and second conductor lines are arranged with a gap domain interposed therebetween in order to electromagnetically couple the first and second distributed constant lines with each other by arranging the first and second conductor lines in collinear alignment.

In this way, the construction of the invention is provided with a gap domain between the first and second conductor lines for electromagnetically coupling the conductor lines with each other instead of connecting the first and second conductor lines with each other by means of a mechanical bridging member. The electrostatic capacity between the respective conductor lines can be made larger than in a case of connecting them by means of a bridging member, and a distributed coupling, namely, an electromagnetic coupling, can be made between these conductor lines by cooperation of the gap domain and the underlayer metal plate. Therefore, since it is not necessary to connect the conductor lines with each other by means of a mechanical bridging member such as a wire or the like as required in the prior art, the characteristics are not deteriorated by an inductance contained in a mechanical bridging member such as a wire and therefore the distributed constant lines can be coupled at high frequency.

And according to a preferred embodiment of a microwave circuit of the present invention, it is preferable to make the following construction. The first conductor line is provided with a first gap extending in the direction perpendicular to the direction of collinear alignment of the first and second conductor lines. The second conductor line is provided with a second gap extending in the direction perpendicular to the direction of collinear alignment of the first and second conductor lines. Assuming that the wavelength corresponding to the central frequency of a desired frequency band is $\lambda$, the distance in the alignment direction, between the first gap and the gap domain, and the distance in the alignment direction between the second gap and the gap domain are, respectively, set at $m\lambda/2$ (where m is an integer).

In this way, the first and the second conductor line are divided, respectively, by the first and the second gap provided at specified positions of the first and the second conductor line. The positions of these gaps, namely the dividing positions, are as follows. That is to say, the gaps are provided at the positions where the respective sub-lines of the first and second conductor lines formed by division at the sides of the gap domain have a length equal to an integer times half of the wavelength when they are measured along the collinear alignment of direction of the first and second conductor lines.

The first and second gaps provided at such positions are made "open", the gap domain is made "open", and in cooperation with the first and second gaps and the gap domain, the position (middle position) which is on the line passing through the first gap and the gap domain and is equally distant from both of the first gap and the gap domain, is short-circuited (conductive) and the position (middle position) which is on the line passing through the second gap and the gap domain and is equally distant from both of the second gap and the gap domain, is also short-circuited (conductive). Accordingly, a standing wave is excited which has a node at each of the short-circuited (conductive) positions between the first and second gaps and has an antinode at each of the opened positions, and the first and second distributed constant lines are coupled with each other at high frequency. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore the distributed constant lines can be coupled with each other at high frequency and as a result a construction having a more excellent signal propagation characteristic than with the prior art can be attained.

According to another example of a preferred construction of a microwave circuit of the present invention, the gap domain is filled with a dielectric material.

In such a way, by filling the gap domain between the dielectric substrates with a dielectric material, an electrostatic capacity provided between the first and second distributed constant lines can be increased, and so an electromagnetic coupling between these distributed constant lines can be strengthened. As a result, a construction having a more excellent signal propagation characteristic than the prior art can be attained.

According to a third preferred embodiment of a microwave circuit of the present invention, it is also possible to make the following construction. The first dielectric substrate is provided with a first L-shaped line composed of a first coupling conductor line rectangular in shape, which is provided in parallel with the direction of collinear alignment of the first and second conductor lines, and a first head-opened conductor line rectangular in shape, which is joined with one end of the first coupling conductor line and extends in the direction perpendicular to said arrangement direction. The second dielectric substrate is provided with a second L-shaped line composed of a second coupling conductor line rectangular quadrilateral in shape, which is provided in parallel with the alignment direction and a second head-opened conductor line rectangular quadrilateral in shape, which is joined with one end of the second coupling conductor line and extends in the direction perpendicular to said alignment direction. Assuming that the wavelength corresponding to the central frequency of a desired frequency band is $\lambda$, the lengths of the first and second L-shaped lines in the alignment direction and the lengths of the first and second L-shaped lines the direction perpendicular to the alignment direction are respectively set at $n\lambda/4$ (where n is an odd number).

In such a way, the first and second L-shaped lines, each of which is in a shape obtained by bending a rectangular parallelepiped at its middle are provided respectively at specified positions of the first and second distributed constant lines. In this case, the end which is opposite to the end facing the conductor line, and which is an end of the head-opened conductor line forming the L-shaped line, is open, and the end which is opposite to the side connected with the head-opened conductor line and which is an end of the coupling conductor line, namely, the end at the side facing the gap domain, is also open. And the end which is at the side connected with the head-opened conductor line and an end of the coupling conductor line, namely, the end at the side opposite to the side facing the gap domain, is short-circuited (conductive). This short-circuited conductive end corresponds to the end edge, opposite to the side facing the gap domain, of the head-opened conductor line.

Further, a specified position of the conductor line is short-circuited due to a distributed constant coupling (edge coupling) effect between the coupling conductor line and the conductor line. Accordingly, a standing wave which has nodes at the positions where the first and second conductor lines are short-circuited (conductive) and an antinode at the gap domain where they are open, is excited, and thus the first and second distributed constant lines are coupled with each other at high frequency. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore the distributed constant lines can be coupled with each other at high frequency and a construction having a more excellent signal propagation characteristic in comparison with the prior art can be attained.

According to a fourth preferred embodiment of a microwave circuit of the present invention, the gap domain is filled with a dielectric material.

In such a way, by filling the gap domain between the dielectric substrates with a dielectric material, an electrostatic capacity between the first and second distributed constant lines can be increased, and so an electromagnetic coupling between these distributed constant lines can be strengthened. As a result, a construction having a more excellent signal propagation characteristic than the prior art can be attained.

And according to a fifth preferred embodiment of a microwave circuit of the present invention, it is preferable to make the following construction. The first dielectric substrate is provided with a first coupling conductor line that is rectangular quadrilateral in shape and provided in parallel with the direction of collinear alignment of the first and second conductor lines. A first via-hole is formed at one end of the first coupling conductor line the other end of which is at one of the sides where the first and second conductor lines face each other. Furthermore, the second dielectric substrate is provided with a second coupling conductor line that is rectangular quadrilateral in shape provided and in parallel with the alignment direction. A second via-hole is formed at one end of the second coupling conductor line the other end of which is at one of the sides where the first and second conductor lines face each other. Assuming that the wavelength corresponding to the central frequency of a desired frequency band is $\lambda$, the lengths of the first and second coupling conductor lines in the alignment direction are set at $n\lambda/4$ (where n is an odd number).

Here, a via-hole is a structure composed of a vertical conducting path for providing electrical continuity between the upper and lower wiring layers which are stacked and a conductor formed in this conducting path. In such a way, since portions where the first and second via-holes are provided are short-circuited (conductive) by making these via-holes at specified positions through the first and second coupling conductor lines and providing these first and second coupling conductor lines at specified positions of the first and second distributed constant lines, a specified position of the conductor line can be short-circuited due to a distributed coupling (edge coupling) effect between the coupling conductor line and the conductor line. Accordingly, a standing wave which has nodes at the positions where the first and second conductor lines are short-circuited (conductive) and has an antinode at the gap domain where they are open is excited, and so the first and second distributed constant lines are coupled with each other in high frequency. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore the distributed constant lines can be coupled with each other at high frequency and a construction having a more excellent signal propagation characteristic than the prior art can be attained.

According to a sixth preferred embodiment of a microwave circuit of the present invention, the gap domain is filled with a dielectric material.

In such a way, by filling the gap domain between the dielectric substrates with a dielectric material, an electrostatic capacity between distributed constant lines forming the respective chips can be increased, and so an electromagnetic coupling between these distributed constant lines can be strengthened. As a result, a construction having a more excellent signal propagation characteristic than the prior art can be attained.

According to a seventh preferred embodiment of a microwave circuit of the present invention, the distributed constant line is composed as a microstrip line.

A microstrip line is a signal transmission line in which the characteristic impedance formed by a dielectric (a dielectric substrate) between a grounding surface as a grounding conductor and a wiring surface as a conductor line is controlled. The characteristic impedance can be changed by selecting the dielectric constant and thickness of the dielectric, and the width and thickness of the wiring. In a high-frequency circuit whose resonant of characteristic frequency is equal to or higher than the microwave band, an arbitrary impedance can be attained by changing the length of the line, and a two-dimensional waveguide such as a microstrip line is more often used as a distributed constant circuit because it is smaller in size, lighter in weight, simpler in construction, and easier to manufacture in comparison with a three-dimensional waveguide such as a coaxial cable and an ordinary waveguide. Accordingly, by using a microstrip line as a distributed constant line, a microwave circuit becomes easy to integrate, and results in the advantages that it has a broad-band performance, its circuit elements, and is little influenced by parasitic elements are easy to mount.

BRIEF DESCRIPTION OF THE DRAWINGS

The foregoing and other objects, features and advantages of the present invention will be better understood from the following description taken in connection with the accompanying drawings, in which.

DESCRIPTION OF THE PREFERRED EMBODIMENTS

According to a conventional technique, one distributed constant line is provided with one conductor line. Quite in contrast, the present invention is mainly directed to a characteristic structure where this single conductor line is divided into two or more portions or a characteristic structure where one conductor line is provided with one or two or more auxiliary lines. In such a structure, the present invention promotes coupling two distributed constant lines with each other electromagnetically, namely, at high frequency, by providing a gap domain (or space) between two conductor lines and arranging these conductor lines in collinear alignment.

In a first embodiment, explanations are given to a construction where one conductor line is divided into two or more portions or parts (see FIGS. 1 to 5). That is to say, in this construction, two distributed constant lines are coupled with each other in high frequency by making short-circuited, respectively, a middle position between the first line position and the gap domain and a middle position between the second line position and the gap domain, when the first line position of the first conductor line is made open, the second line position of the second conductor line is made open, and the gap domain is made open.

In a second and a third embodiment, explanations are given of constructions where auxiliary lines (L-shaped lines or coupling conductor lines as described later) are provided in addition to the conductor lines (see FIGS. 6 to 17). In these constructions, distributed constant lines are coupled with each other at high frequency by making short-circuited the first line position of the first conductor line and making short-circuited the second line position of the second conductor line and making the gap domain open.

With reference to the drawings, detailed descriptions will hereinafter be given to the embodiments of the invention. The drawings are shown roughly to a degree such that construction, size, and layout of the invention can be understood, and the numerical conditions and the like as described in the following are only some examples, and therefore the present invention is not limited to these embodiments at all.

First Embodiment

Figure 1:
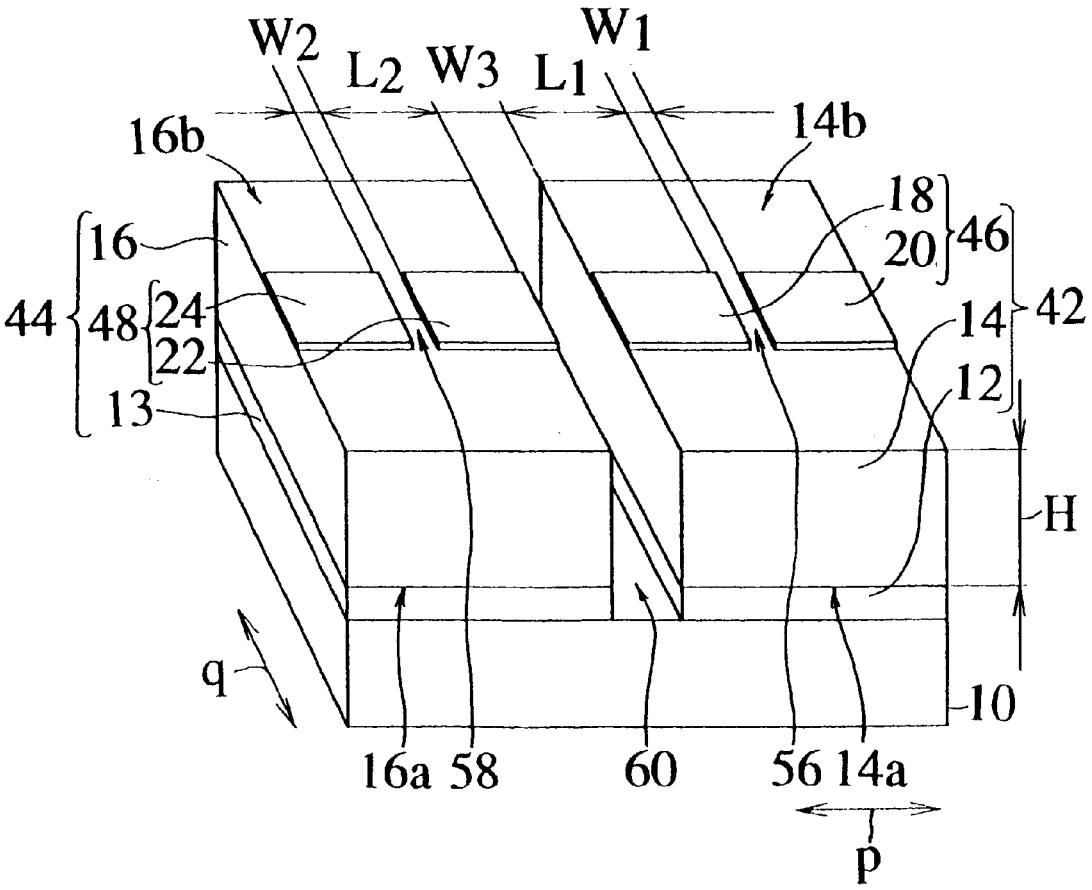
FIG. 1 is a perspective view showing the construction of a first embodiment of an apparatus used for explaining a method and an apparatus of the present invention.

FIG. 1 is a perspective view for showing construction of a first embodiment of a microwave circuit according to the present invention. As shown in FIG. 1, this first construction is a construction where a first and a second conductor line 46 and 48 are arranged in collinear alignment with a gap domain 60 interposed between them.

In this embodiment, a first microstrip line 42 as a first distributed constant line, and a second microstrip line 44 as a second distributed constant line are provided on an underlayer metal plate (or a grounding metal plate) 10. The first microstrip line 42 and the second microstrip line 44 are separated from each other by the gap domain or space 60 interposed between them. The first microstrip line 42 comprises a first grounding conductor 12, a first dielectric substrate 14, and a first conductor line 46 which are stacked one upon another. The second microstrip line 44 comprises a second grounding conductor 13, a second dielectric substrate 16, and a second conductor line 48 which are stacked one upon another. The first dielectric substrate 14 has a lower surface 14*a* and an upper surface 14*b* which are in parallel with each other, and the first grounding conductor 12 is provided on the lower surface (surface shown by an arrow 14*a* in FIG. 1) and the first conductor line 46 is provided on the upper surface 14*b*. In the same way, the second dielectric substrate 16 has a lower surface 16*a* and an upper surface 16*b* which are in parallel with each other, and the second grounding conductor 13 is provided on the lower surface (surface shown by an arrow 16*a* in FIG. 1) and the second conductor line 48 is provided on the upper surface 16*b*. The first and second microstrip lines 42 and 44 are positioned on the underlayer metal plate 10 so that the first and second conductor lines 46 and 48 thereof can be arranged in collinear alignment in the longitudinal direction (direction shown by an arrow p in FIG. 1, and also referred to below as the alignment direction or direction of alignment) of them at the same level above the upper surface of the underlayer metal plate 10.

In the first embodiment, each of the first and second conductor lines 46 and 48 is divided into two portions or parts. The first conductor line 46 is provided with a first gap 56 extending in the direction perpendicular to it (direction shown by an arrow q in FIG. 1, or the direction perpendicular to the direction p) and that separates the first conductor line 46 into a first sub-line 18 and a second sub-line 20 which are arranged successively in collinear alignment in a direction away from the gap domain 60. The second conductor line 48 on the opposite side of the gap domain 60 is provided with a second gap 58 extending in the direction perpendicular to the direction p and that separates the second conductor line 48 into a third sub-line 22 and a fourth sub-line 24 which are arranged successively in collinear alignment in a direction away from the gap domain 60. Since the first and second conductor lines 46 and 48 are rectangular quadrilateral in shape, the first and second sub-lines 18 and 20, being separated by the first gap 56, are also rectangular quadrilateral in shape, and the third and fourth sub-lines 22 and 24, being separated by the second gap 58, are also rectangular quadrilateral in shape. It is assumed that the first and second gaps 56 and 58, respectively, are uniformly W1 and W2 in width when measured in the alignment direction.

In the first embodiment, when assuming that the wavelength corresponding to the central frequency of a desired frequency band is λ, the distances in the alignment direction p between the first gap 56 and the gap domain 60 and between the second gap 58 and the gap domain 60, namely the lengths of the first and third sub-lines 18 and 22 in the alignment direction p, are respectively set at mλ/2 (where m is a positive integer). The construction of FIG. 1 is a case of "m=1". Although an integer 1, 2, 3 or the like can be set as the integer m, since a wave in the dominant mode is easier to excite, a wave being as low as possible in degree, namely, a wave of "m=1," is the optimum.

When the respective distances along the alignment direction p between the first gap 56 and the gap domain 60 and between the second gap 58 and the gap domain 60 are set as described above, the respective lengths L1 and L2 of the first and third sub-lines 18 and 22 in the alignment direction p are λ/2 in case of "m=1". The domain length of the gap domain 60, namely, the distance W3 in the alignment direction p between the first dielectric substrate 14 and the second dielectric substrate 16, is shorter in comparison with wavelength λ, it can be considered that the distance $(L_1+L_2+W_3)$ in the arrangement direction p between the first and second gaps 56 and 58 is set at an integer times the wavelength λ. Or the distance in the alignment direction p between the first and second gaps 56 and 58 may be adjusted so that it may be equal to an integer times the wavelength λ. That is to say, it is assumed that the above-mentioned respective lengths or distances may have an error (acceptable error) so small that it does not have a substantial influence upon a desired signal propagation characteristic.

The first and second gaps 56 and 58, respectively, are made electrically open (nonconductive). A position, which is between the first gap 56 and the gap domain 60 and is equally distant from them in the alignment direction p, is electrically short-circuited (conductive), and a position, which is between the second gap 58 and the gap domain 60 and is equally distant from them in the alignment direction p, is electrically short-circuited (conductive). Accordingly, a microwave signal of wavelength λ will resonate between the first and second gaps 56 and 58.

The conditions are as followings:

The first line position of the first conductor line 46, namely, the position of the first gap 56, is made open (nonconductive); the second line position of the second conductor line 48, namely, the position of the second gap 58 is made open; the gap domain 60 is made open; a middle position between the first line position and the gap domain 60 and a middle position between the second line position and the gap domain 60 are both short-circuited (conductive); and it is assumed that the wavelength corresponding to the central frequency of a desired frequency band is λ. As is apparent from the above description, a microwave signal will be able to resonate between the first line position and the second line position, namely, between the first and second gaps 56 and 58, by the distance between these mλ/2 (where m is an integer), each of the distances between the first line position and the gap domain 60, and the distance between the second line position and the gap domain 60, under the following conditions. A standing wave of the microwave signal is excited between the first and second gaps 56 and 58 by this resonance phenomenon. Therefore, in cooperation with an effect of the underlayer metal plate 10 connecting the first grounding conductor 12 with the second grounding conductor 13, the first and second microstrip lines 42 and 44 are coupled with each other electromagnetically, namely, at high frequency. That is to say, these microstrip lines 42 and 44 are short-circuited at high frequency and a microwave signal can pass through the gap 60 between them without being reflected by the gap.

In such a construction according to the first embodiment, the microwave circuit of the present invention has the first and second gaps 56 and 58 provided therein. In the microwave circuit, the distance in the alignment direction p between the first and second gaps 56 and 58 is set at an integer times the wavelength of a microwave to cause resonation of a microwave, signal between the first and second gaps 56 and 58 and thereby couple the first and second microstrip lines 42 and 44 with each other at high frequency.

The first conductor line 46 and the second conductor line 48 of the first embodiment, namely, the first, second, third, and fourth sub-lines 18, 20, 22, and 24, are all equal to one another in width. And an interval in the alignment direction p between the first and second sub-lines 18 and 20, namely, the length W1 of the first gap 56 in the alignment direction p and an interval in the alignment direction p between the third and fourth sub-lines 22 and 24, namely, the length W2 of the second gap 58 along the arrangement direction p, are set smaller than the thickness H of the first and the second dielectric substrates 14 and 16 in consideration of expansion or divergence of an electromagnetic wave. The length W3 of a domain (the gap domain 60) in the alignment direction p between the first and second conductor lines 46 and 48 is set smaller than the thickness H of the first and the second dielectric substrates 14 and 16, in consideration of expansion or divergence of an electromagnetic wave (and is set smaller than $\lambda/2$). Polytetrafluoroethylene (trade name: Teflon) or the like is used as a material for the first and second dielectric substrates 14 and 16.

Figure 2A:
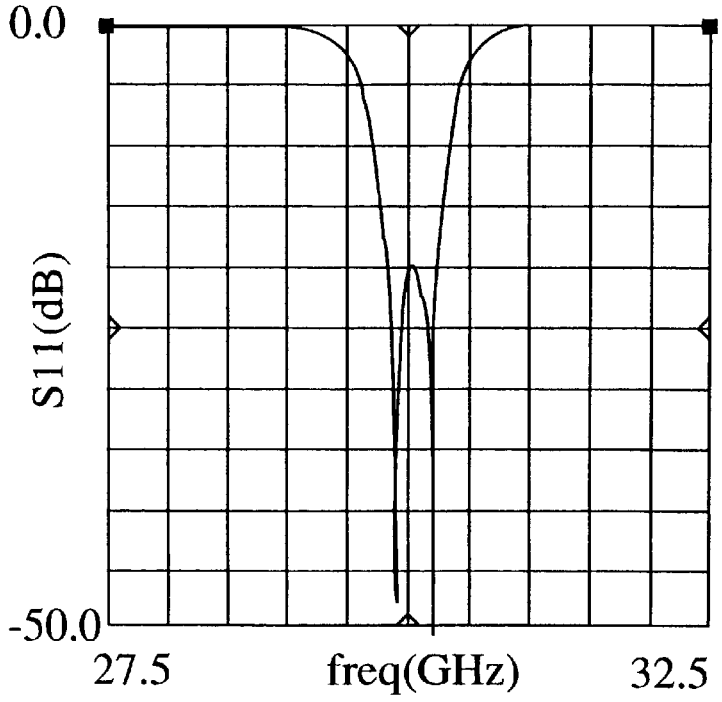
FIGS. 2(A) and 2(B) are graphs showing a result of a simulation of the construction shown in FIG. 1.
Figure 2B:
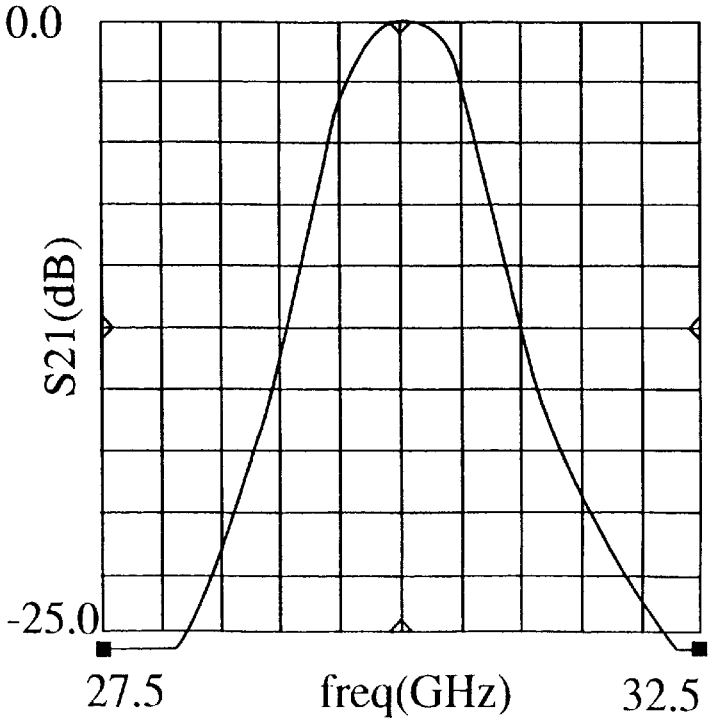
Figure 3A:
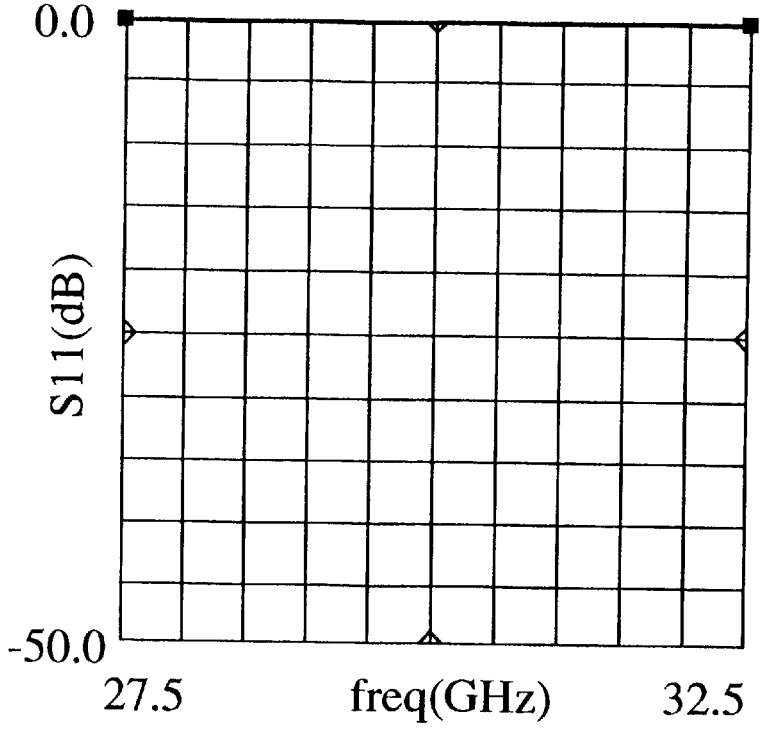
FIGS. 3(A) and 3(B) are graphs showing a result of a simulation of a construction according to the prior art.
Figure 3B:
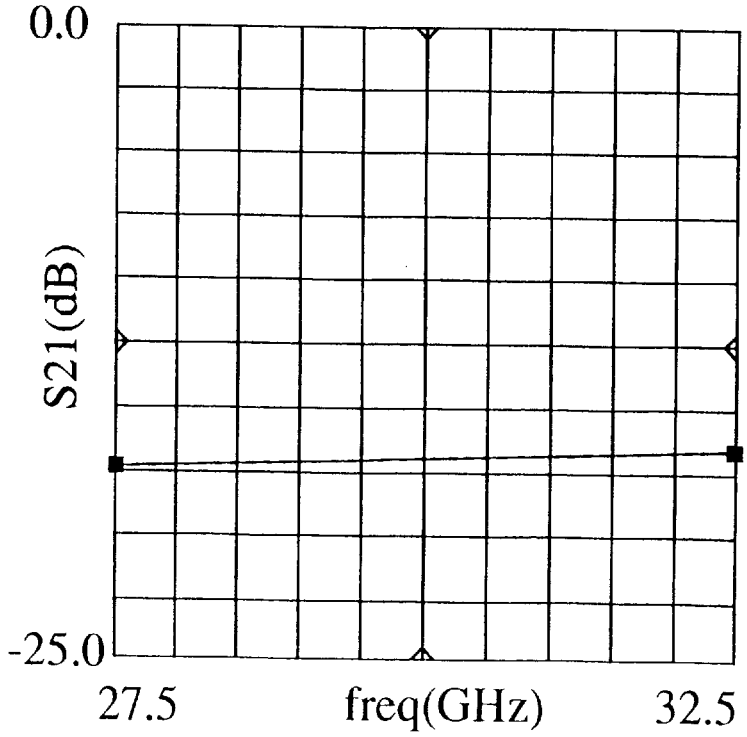

Next, operation of the first construction is described on the basis of a result of simulation. FIGS. 2(A) and 2(B) are graphs for showing a result of simulation of a signal propagation characteristic of the first embodiment of the present invention. FIGS. 3(A) and 3(B) are graphs for showing a result of simulation of a signal propagation characteristic of a conventional construction for the purpose of comparison with the result of FIGS. 2(A) and 2(B). FIGS. 2(A) and 2(B) show a result in case of the first construction provided with the first and second gaps 56 and 58, and FIGS. 3(A) and 3(B) show a result in the case of the conventional construction not provided with the first and second gaps 56 and 58. In FIGS. 2(A) and 3(A), the ordinate axis represents a reflection coefficient S11 (S parameter) in a range from 0 to −50 dB (decibel), and in FIGS. 2(B) and 3(B), the ordinate axis represents a transmission coefficient S21 (S parameter) in a range from 0 to −25 dB (decibel). In each of the figures, the abscissas axis represents the frequency of a microwave in a range from 27.5 to 32.5 GHz (gigahertz).

Simulation of this embodiment has been performed by using a Microwave Design System (MDS) which is a trade name and is manufactured by Yokogawa-Hewlett-Packard, Ltd. In this simulation, the central frequency f is set at 30 GHz. Accordingly, the wavelength $\lambda$ corresponding to this frequency f is about 0.7 cm in consideration of the dielectric constant of a medium in which a microwave is guided through. In case of not providing the first and second gaps 56 and 58, as a result of simulation of a conventional construction as shown in FIG. 3, the reflection coefficient S11 has a constant value of 0 dB over a range of measured frequencies (see FIG. 3(A)), and the transmission coefficient S21 is in a range from −16.6 dB to −17.5 dB over a range of measured frequencies (see FIG. 3(B)), and so it is found that a microwave is almost reflected by the gap domain 60 and that the distributed constant lines (the first and second microstrip lines 42 and 44) are not coupled with each other.

Next, in the first embodiment provided with the first and second gaps 56 and 58, other constant values set in the simulation are as follows.

Thickness H of the first and second dielectric substrates 14 and 16=0.3 mm Dielectric constant of the first and second dielectric substrates 14 and 16=10.4

$L_1=L_2=3.4$ mm $W_1=W_2=0.02$ mm $W_3=0.2$ mm

In this way, the distance $(L_1+L_2+W_3)$ in the alignment direction p between the first and second gaps 56 and 58 is set at 7.0 mm, and the lengths L1 and L2 of the first and second gaps 56 and 58 in the alignment direction p are set at about ½ of the wavelength $\lambda$. As a result of simulation of the first constructional example of FIG. 2(A), the reflection coefficient S11 shows a value of about −50.0 dB near the central frequency f (see FIG. 2(A)), and the transmission coefficient S21 shows 0 dB at the central frequency f (see FIG. 2(B)) and shows a filter characteristic of a band-pass type. As is apparent from the simulation results for this first construction, in the construction of the first embodiment provided with the first and second gaps 56 and 58, a microwave signal resonates between the first and second gaps 56 and 58 and passes through the gap 60 without being reflected by the gap 60, and the first and second microstrip lines 42 and 44 are coupled with each other electromagnetically, namely, at high frequency.

As described above, the construction of this first embodiment is a construction using no mechanical bridging member such as a wire or the like in order to couple the microstrip lines with each other, as distributed constant lines at high frequency. Therefore, since there is not a problem of an inductance caused by a mechanical bridging means such as a wire, microstrip lines can be coupled with each other at high frequency and a signal propagation characteristic in such a high frequency as a millimetric wave is improved.

Figure 4:
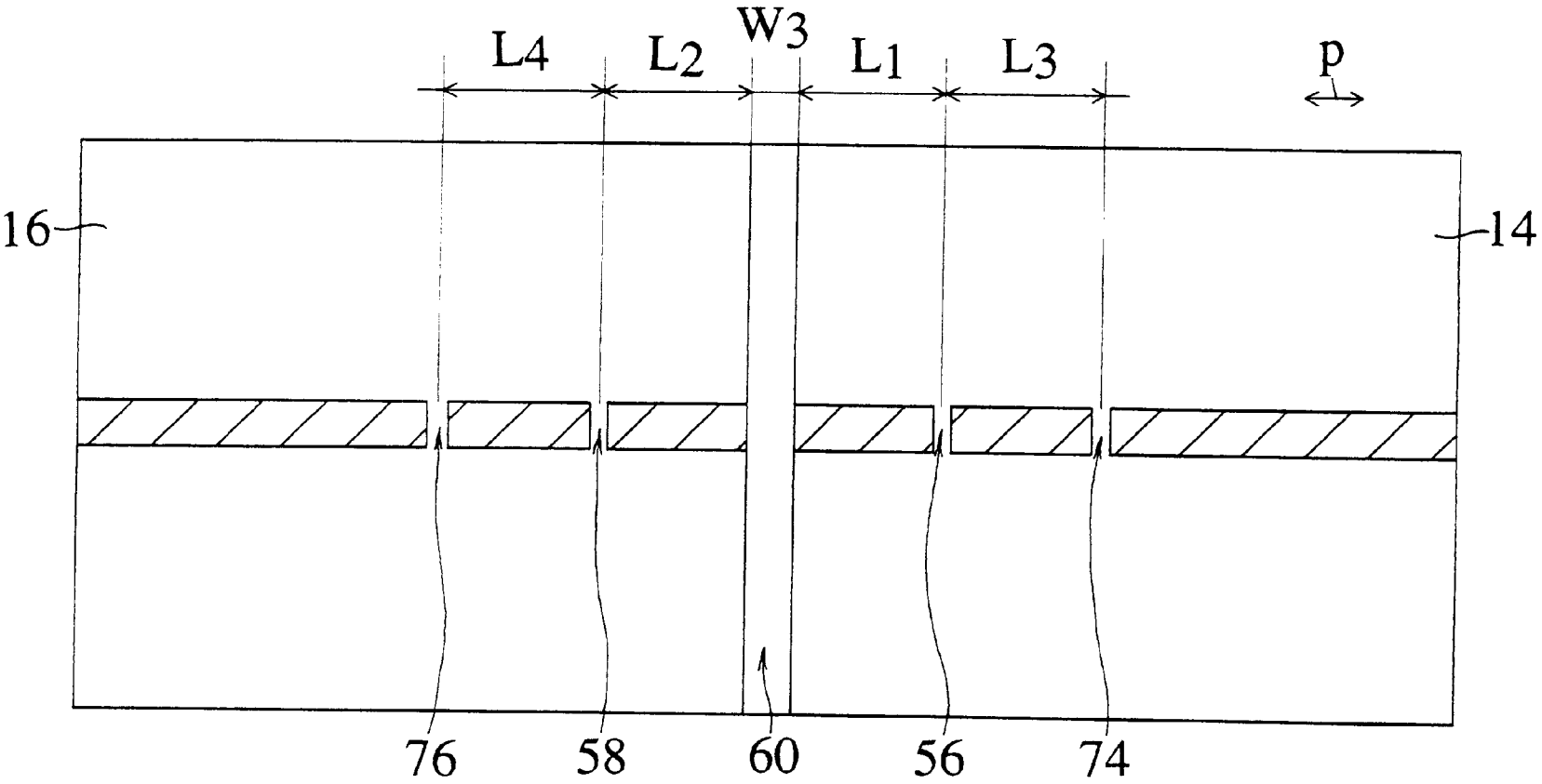
FIG. 4 is a plan view showing a variation of a construction of the first embodiment.

Although in this embodiment one gap (the first gap 56 or the second gap 58) is provided in each of the first and second conductor lines 46 and 48, respectively of the first and second microstrip lines 42 and 44, each of the conductor lines may be divided into three or more sub-lines by providing them with two or more gaps, without being limited to this construction. FIG. 4 shows a plan view of a variation of the first construction, in which each of the first and second conductor lines 46 and 48 is provided with two gaps. In FIG. 4, the conductor lines are shown by cross-hatching and reference numbers for them are omitted.

In the construction of this variation, a third gap 74 is provided at the conductor line position opposite to the gap domain 60 with the first gap 56 interposed between them, and a fourth gap 76 is provided at the conductor line position opposite to the gap domain 60 with the first gap 58 interposed between them. The first gap 56 is at a position which is a distance L1=$\lambda/2$ from the gap domain 60 in the alignment direction p (in the case of m=1), and the third gap 74 is at a position which is a distance L3=λ/2 from the first gap 56 in the alignment direction p (where the length W1 of the first gap 56 in the alignment direction p and the width (length) of the third gap 74 are omitted since they have values that do not have an influence upon the signal propagation characteristic), namely, the third gap 74 is at a position which is a distance λ from the gap domain 60.

The second gap 58 is at a position which is a distance L2=λ/2 from the gap 60 in the alignment direction p (where the length W2 of the second gap 58 in the alignment direction p and the width (length) of the fourth gap 76 are omitted since they have values that do not have an influence upon the signal propagation characteristic) (in the case of m=1), and the fourth gap 76 is at a position which is a distance L4=λ/2 from the second gap 58 in the alignment direction p, namely, at a position which is a distance λ from the gap 60. The construction of this variation has the same effect as the first construction shown in FIG. 1.

Figure 5:
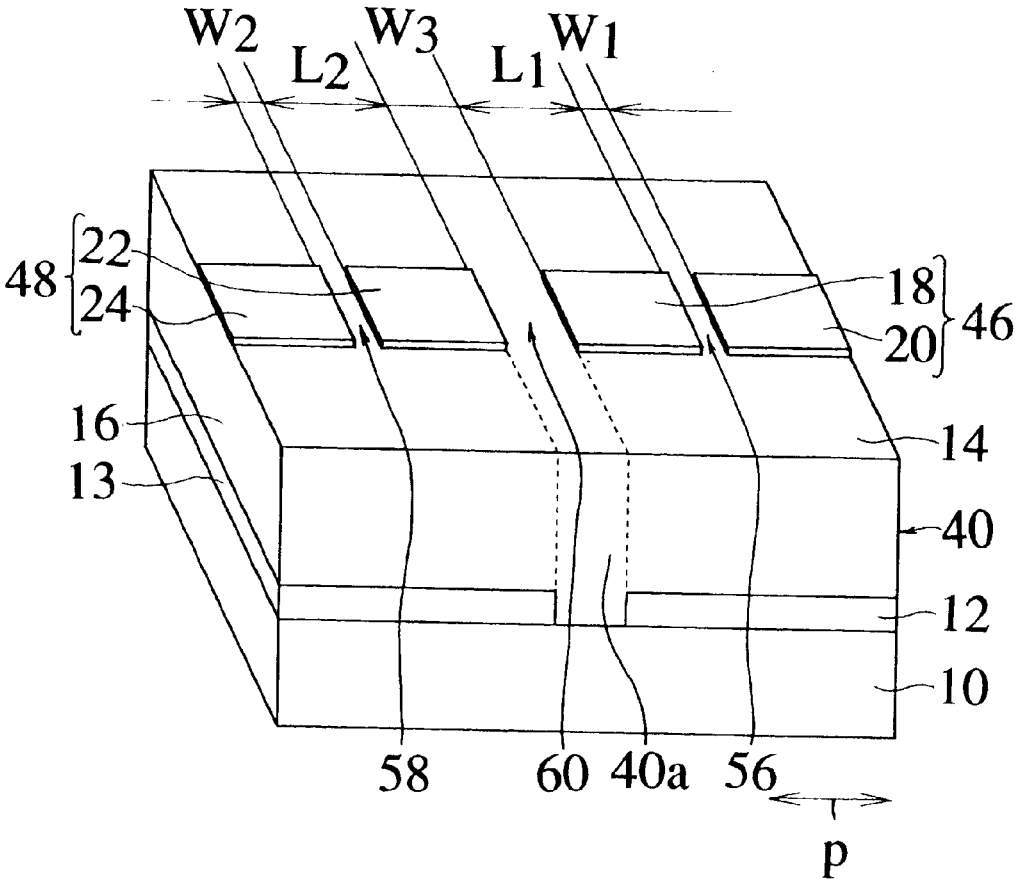
FIG. 5 is a perspective view showing another construction of the first embodiment.

FIG. 5 is a perspective view for showing a second construction of the first embodiment. The construction has a dielectric material filling in the gap 60. Thus, the dielectric substrates and the dielectric material filling in the gap 60 form one continuous body. The first and second dielectric substrates 14 and 16 of the first construction are combined with each other in one body by means of a layer 40*a* of the same dielectric material as these dielectric substrates to form one dielectric substrate 40. In such a way, since an electrostatic capacity provided between the first and second microstrip lines 42 and 44 can be increased by filling the gap 60 with a dielectric material, a very strong coupling between these microstrip lines 42 and 44 can be obtained. A dielectric material to fill the gap domain 60 does not have to be the same as the material for the first and second dielectric substrates 14 and 16, and may be a different dielectric material from those of the substrates 14 and 16. For example, epoxy resin or the like may preferably be used as the dielectric material.

The above-mentioned second construction of the first embodiment can be used as a filter formed on the dielectric substrate. Like the signal propagating characteristic of the simulation result shown in FIG. 2, the second construction of the first embodiment shows a filter characteristic of a band-pass type. Accordingly, a filter of a band-pass type which is small in size and excellent in characteristic of Q value or the like can be obtained by adopting the construction of FIG. 5. For example, as shown in the variation example of the first constructional example of FIG. 4, the bandwidth of such a band-pass filter can be adjusted by changing the number of plural gaps arranged in series on one dielectric substrate.

Second Embodiment

Next, with reference to FIGS. 6 to 12, construction of a second embodiment of a microwave circuit according to the present invention will hereinafter be described. Description of the same construction as described in the first embodiment may be omitted in order to avoid the overlapping explanation.

Figure 6:
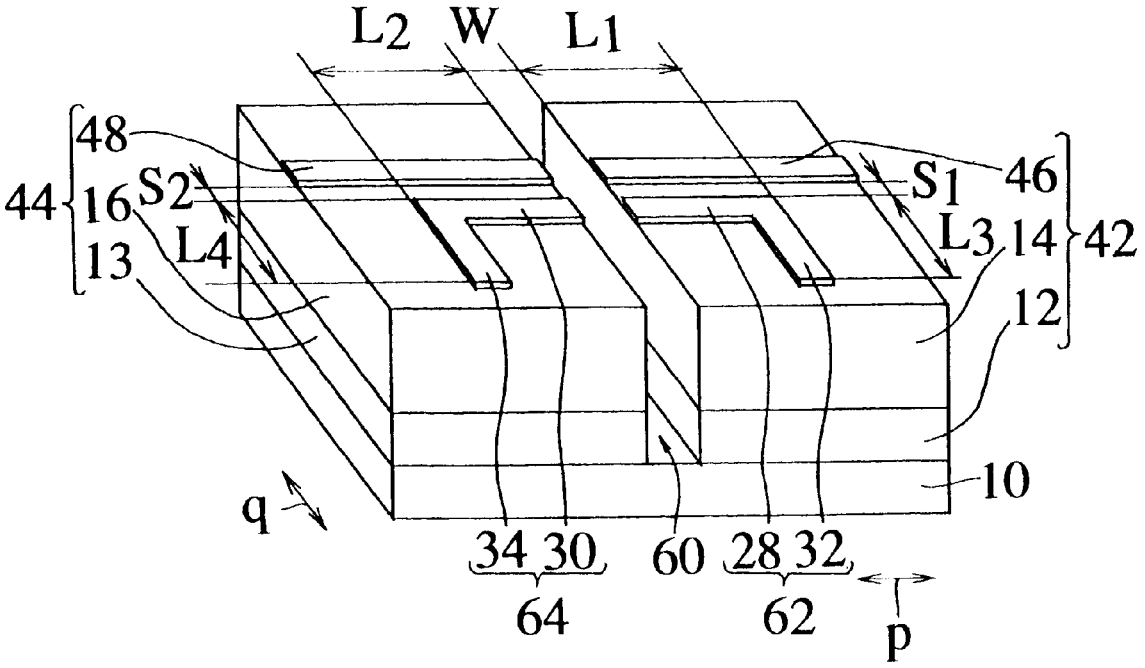
FIG. 6 is a perspective view showing a construction of a second embodiment of an apparatus used for explaining a method and an apparatus of the present invention.
Figure 7:
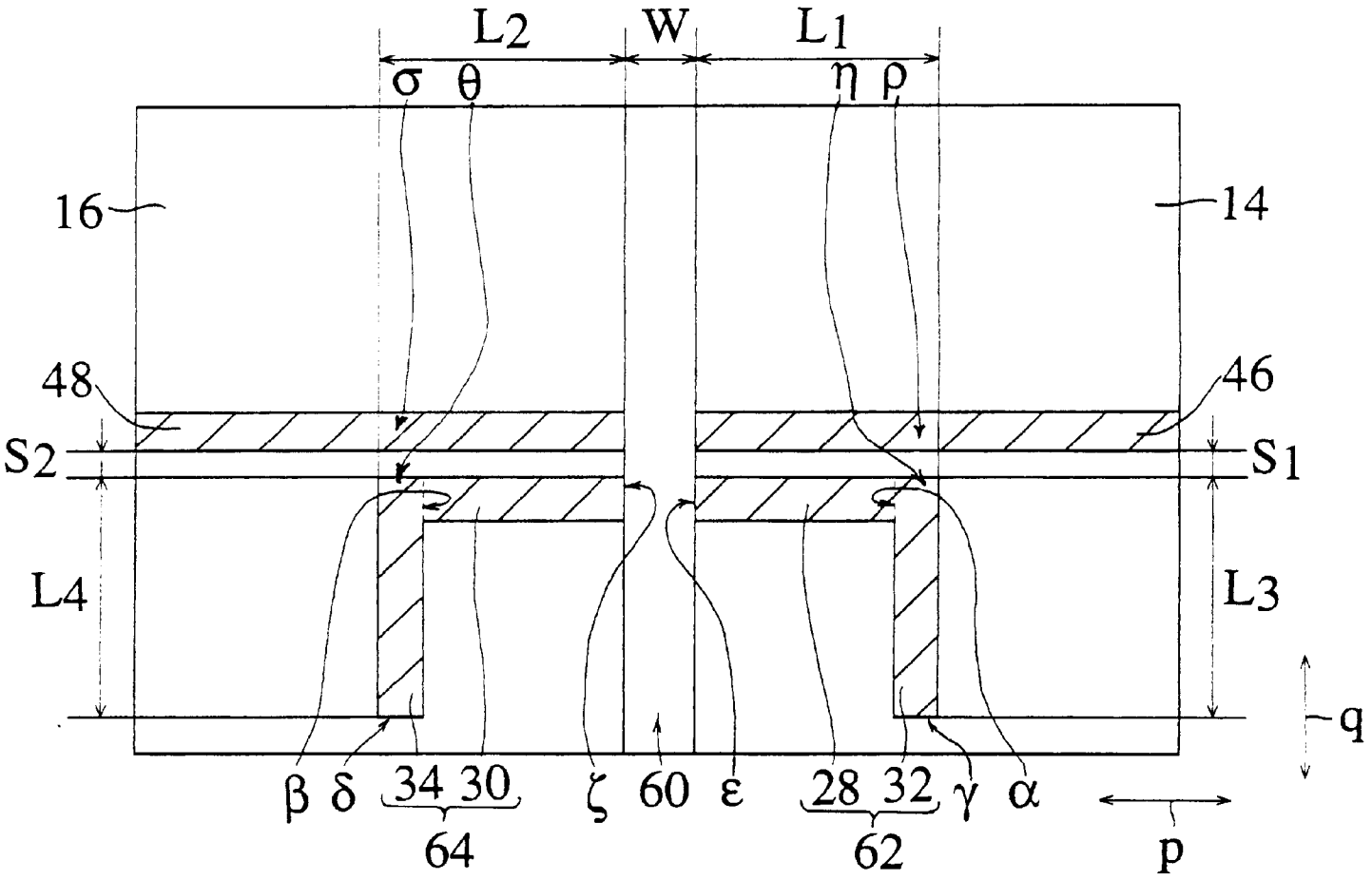
FIG. 7 is a plan view of construction of the second embodiment.

FIG. 6 is a perspective view for showing the construction of the second embodiment. FIG. 7 is a plan view for showing the construction of the second embodiment of FIG. 6. In FIG. 7, conductor lines and L-shaped coupling lines are shown with cross-hatching. As shown in FIGS. 6 and 7, the construction of this second embodiment is different from those of the first embodiment in FIGS. 1, 4 and 5. In the second embodiment, each of the first and second conductor lines 46 and 48 is formed as an independent continuous conductor line which is rectangular quadrilateral in shape without being divided. The first and second conductor lines 46 and 48 are linearly arranged with a gap domain 60 interposed between them.

In the second embodiment, the first and second conductor lines 46 and 48 are in the shape of a rectangular parallelepiped. The first and second conductor lines 46 and 48 are arranged so that their longitudinal direction may coincide with the arrangement direction p. A first L-shaped line 62 and a second L-shaped line 64 are formed respectively on the first and second dielectric substrates 14 and 16 adjacently to (without being in contact with each other) the first and second conductor lines. The first L-shaped line 62 comprises a first coupling conductor line 28 with a rectangular quadrilateral shape, which is provided in parallel with the arrangement direction p of the first and second conductor lines 46 and 48, and a first head-opened conductor line 32 with a quadrilateral rectangular shape, which is joined with one end of the first coupling conductor line 28 (a portion shown by a dashed line α in FIG. 7) and extends in the direction q perpendicular to the arrangement direction p.

The second L-shaped line 64 comprises a second coupling conductor line 30 with rectangular quadrilateral shape, which is provided in parallel with the alignment direction p, and a second head-opened conductor line 34, rectangular quadrilateral in shape which is joined with one end of the second coupling conductor line 30 (a portion shown by a dashed line β in FIG. 7), and extends in the direction q perpendicular to the arrangement direction p. The ends ϵ and ξ of the first and second coupling conductor lines 28 and 30 at the sides not joined with the first and second head-opened conductor lines 32 and 34, are opposite to each other with the gap domain 60 interposed between them. By providing these L-shaped lines 62 and 64, it is possible to couple electromagnetically, namely, at high frequency, the first microstrip line 42 (comprising the first grounding conductor 12, the first dielectric substrate 14, and the first conductor line 46) and the second microstrip line 44 (comprising the second grounding conductor 13, the second dielectric substrate 16, and the second conductor line 48) as distributed constant lines.

In the second embodiment, for a wavelength λ corresponding to the central frequency of a desired frequency band, the lengths L1 and L2 of the first and second L-shaped lines 62 and 64 in the alignment direction p and the lengths L3 and L4 in the direction q perpendicular to the alignment direction p are respectively set at n λ/4 (where n is a positive odd number). In the construction shown in FIGS. 6 and 7, n is selected to have a value of 1 (n=1). Although an odd number 1, 3, 5 or the like can be given as the odd number n, since it is easier to excite a wave in the dominant mode the value of n should be as low as possible in degree, so that "n=1" is the optimum. Here, the above-mentioned lengths $L_1$ and $L_2$ correspond to the lengths obtained respectively by adding the lengths in the alignment direction p of the first and second coupling conductor lines 28 and 30, respectively, to the widths in the direction p of the first and second head-opened conductor lines 32 and 34. And the lengths L3 and L4, respectively, correspond to the lengths in the direction q of the first and second head-opened conductor lines 32 and 34.

When the dimensions of first and second L-shaped lines 62 and 64 are set as described above, the length $L_1$ of the first L-shaped line 62 in the alignment direction p, the length $L_2$ of the second L-shaped line 64 in the alignment direction p, the length $L_3$ of the first L-shaped line 62 in the direction q perpendicular to the alignment direction p, and the length $L_4$ of the second L-shaped line 64 in the direction q perpendicular to the alignment direction p are each set at $\lambda/4$. When the domain length of the gap domain 60, namely, the distance W in the alignment direction p between the first and second dielectric substrates 14 and 16 is smaller than the wavelength $\lambda$, it can be considered that the sum $(L_1+L_2+W)$ of the lengths of the first and second L-shaped lines 62 and 64 in the alignment direction p and the distance W, is set equal to an integer times ½ of the wavelength $\lambda$. That is to say, $(L_1+L_2+W)=k\cdot\lambda/2$. Here k denotes a positive integer. Accordingly, it is assumed that the lengths L1 and L2 may have an error in size so small that it does not have a substantial influence upon a desired signal propagating characteristic.

At this time, the ends of the head-opened conductor lines 32 and 34 forming the first and second L-shaped lines 62 and 64, opposite to the first and second conductor lines 46 and 48 (portions represented by symbols $\gamma$ and $\delta$ in FIG. 7), are made open (in a state of infinite impedance). And the ends of the first and second coupling conductor lines 28 and 30, opposite to the sides joined with the first and second head-opened conductor lines 32 and 34 (portions represented by symbols $\epsilon$ and $\xi$ in FIG. 7) are also made open. Therefore, the other ends of the first and second head-opened conductor lines 32 and 34 (portions represented by symbols $\eta$ and $\theta$ in FIG. 7) can be short-circuited (in a state of ground potential) by properly setting the sizes ($L_1$, $L_2$, $L_3$ and $L_4$) of the L-shaped lines 62 and 64. For example, when assuming that the wavelength corresponding to the central frequency of a desired frequency band is $\lambda$, "$L_1=L_2=L_3=L_4=\lambda/4$" can be set. Positions to be made opened or short-circuited are not only the above-mentioned ends of lines but also the peripheral domains including them.

It is assumed that the distance along the direction q between the first conductor line 46 and the first L-shaped line 62 is S1 and the distance along the direction q between the second conductor line 48 and the second L-shaped line 64 is S2. These distances S1 and S2 are set smaller than the thickness H of the first and second dielectric substrates 14 and 16 in consideration of expansion divergence of an electromagnetic wave. As a result, distributed couplings are made, respectively, between the conductor lines 46 and 48 and the coupling conductor lines 28 and 30; and the portions (portions represented by symbols $\rho$ and $\sigma$ in FIG. 7) of the conductor lines 46 and 48 near the above-mentioned short-circuited positions $\eta$ and $\theta$ are newly short-circuited. When the distance between the short-circuited positions $\rho$ and $\sigma$ of the conductor lines 46 and 48 (although this distance between $\rho$ and $\sigma$ is actually "$L_1+L_2+W$", since W is smaller in comparison with $L_1$ and $L_2$ in fact, the distance can be approximated by "$L_1+L_2$") is equal to an integer times ½ of the wavelength $\lambda$ of a microwave signal guided through the microstrip lines 42 and 44, this microwave signal can be resonated between the short-circuited positions $\rho$ and $\sigma$. At this time, the microstrip lines 42 and 44 can be coupled with each other electromagnetically, namely, high frequency with the gap domain 60 interposed between them. Therefore, since a mechanical bridging member such as a wire is not necessary for coupling the microstrip lines and an inductance is not inserted between the microstrip lines, this second embodiment results in a greater improvement in signal propagation characteristic in comparison with a conventional construction of the prior art.

In such a way, when the first line position of the first conductor line 46 (the position $\rho$ to be short-circuited) is short-circuited and the second line position of the second conductor line 48 (the position $\sigma$ to be short-circuited) is short-circuited and the gap domain 60 is made open, and when it is assumed that the wavelength corresponding to the central frequency of a desired frequency band is $\lambda$, a microwave signal resonance can be caused between the first line position and the second line position by setting at $n\lambda/4$ the distance between the first line position and the gap domain 60 and the distance between the second line position and the gap domain 60. A standing wave of the microwave signal is formed between the first line position and the second line position by this resonance phenomenon. Therefore, in cooperation with an effect of the underlayer metal plate 10 connecting the first grounding conductor 12 and the second grounding conductor 13 with each other, the first and second microstrip lines 42 and 44 are coupled with each other at high frequency. That is to say, these microstrip lines 42 and 44 are short-circuited electromagnetically, namely, at high frequency, and a microwave signal can pass through without being reflected by the gap domain 60 between them.

Figure 8A:
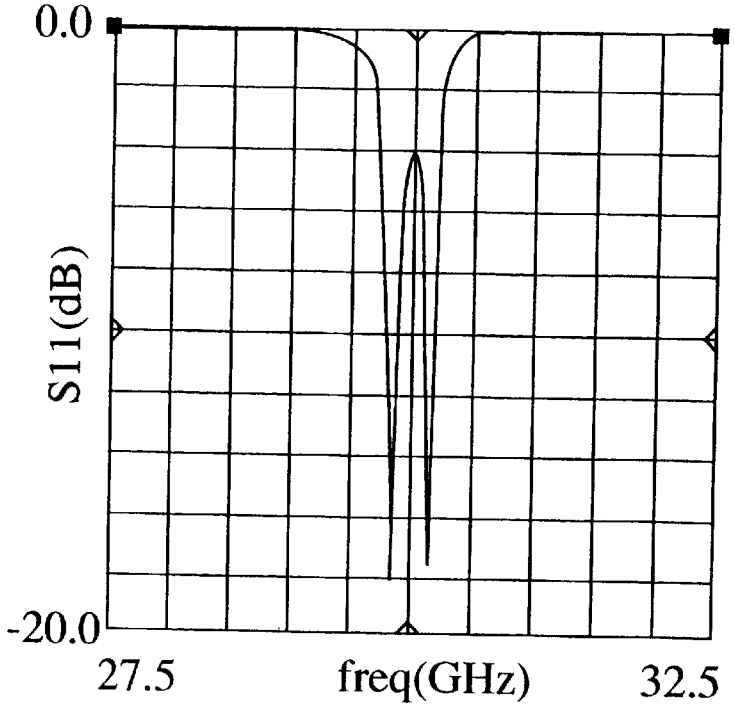
FIGS. 8(A) and 8(B) are graphs showing a result of a simulation of the second construction showing in FIGS. 6 and 7.
Figure 8B:
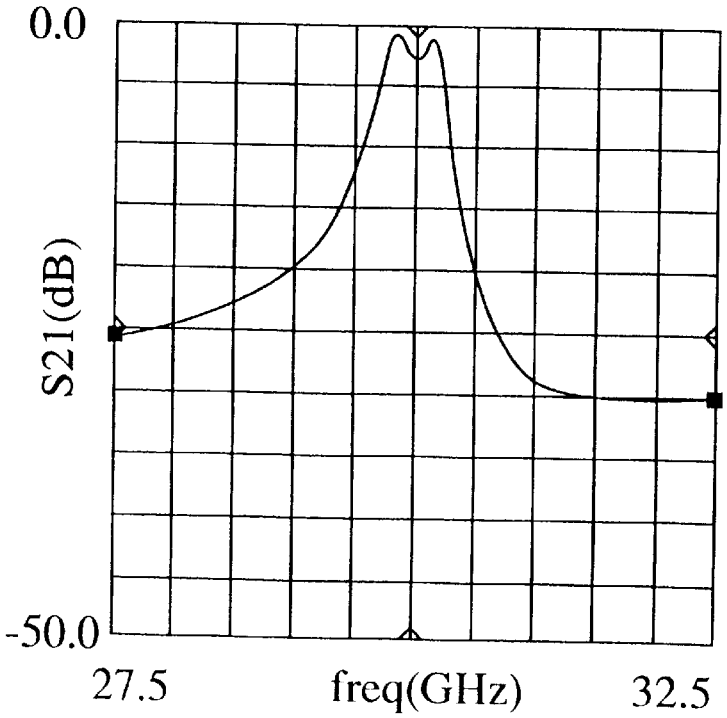
Figure 9A:
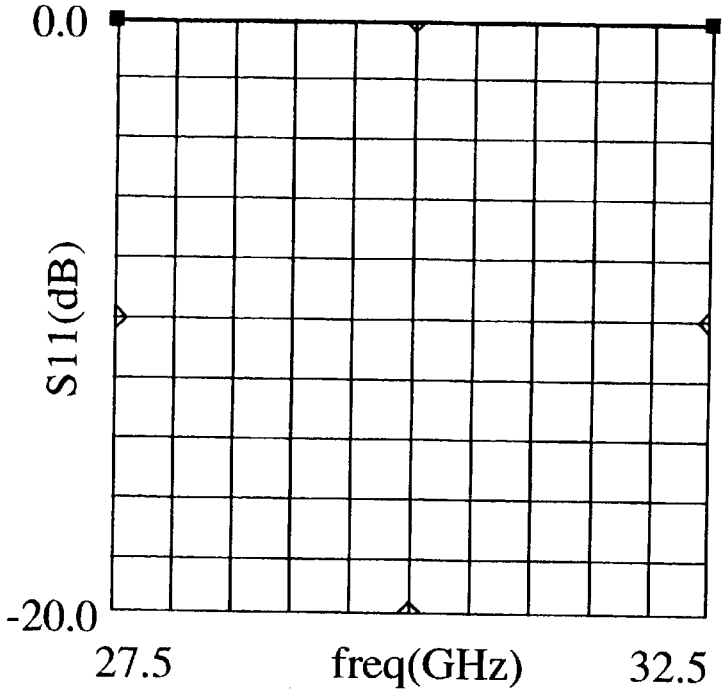
FIGS. 9(A) and 9(B) are graphs showing a result of simulation of a constructional according to the prior art.
Figure 9B:
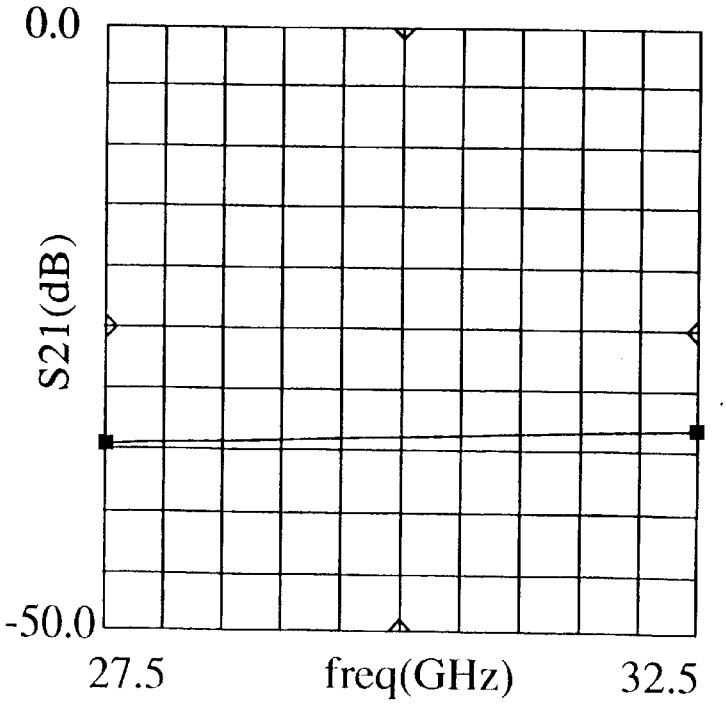

Next, operation of the second embodiment is described on the basis of a result of simulation. FIGS. 8(A) and 8(B) are graphs for showing the result of a simulation of a signal propagation characteristic of the second exemplary construction. FIGS. 9(A) and 9(B) are graphs for showing the result of a simulation of a signal propagation characteristic of a conventional construction for the purpose of comparison with the result of FIGS. 8(A) and 8(B). FIGS. 8(A) and 8(B) show a result in case of the second embodiment provided with the first and second L-shaped lines 62 and 64, and FIGS. 9(A) and 9(B) show a result in case of the conventional constructional example not provided with the first and second L-shaped lines 62 and 64. In FIGS. 8(A) and 9(A), the ordinate axis represents a reflection coefficient S11 (S parameter) in a range from 0 to −20 dB (decibel), and in FIGS. 8(B) and 9(B), the ordinate axis represents a transmission coefficient S21 (S parameter) in a range from 0 to −50 dB (decibel). In each of the figures, the abscissa axis represents a frequency of a microwave in a range from 27.5 to 32.5 GHz (gigahertz).

Simulation of this second embodiment has been performed in the same way as the simulation of the first embodiment, by using a Microwave Design System (MDS) which is a trade name and is manufactured by Yokogawa-Hewlett-Packard, Ltd. In this simulation, the central frequency f is set at 30 GHz (accordingly, the wavelength $\lambda$ corresponding to this frequency f is about 0.8 cm in consideration of the dielectric constant of a medium in which a microwave is guided). If the first and second L-shaped lines 62 and 64 are not provided, then as is apparent from a result of simulation of a conventional constructional example as shown in FIGS. 9(A) and 9(B), the reflection coefficient S11 has a constant value of 0 dB (see FIG. 9(A)), and the transmission coefficient S21 is in a range from −32.5 dB to −35 dB over a range of measured frequencies (see FIG. 9(B)), and so it is found that a microwave is almost reflected by the gap domain 60 and the distributed constant lines are not coupled with each other.

Next, consideration is given to a simulation of the second embodiment, which is provided with the first and second L-shaped lines 62 and 64, and other constant values are set as follows.

Thickness H of the first and second dielectric substrates 14 and 16=0.13 mm Dielectric constant of the first and second dielectric substrates 14 and 16=2.20

$L_1=L_2=L_3=L_4=1.83$ mm $S_1=S_2=0.2$ mm

W=0.1 mm

In this way, the sum ($L_1+L_2+W$) of the lengths of the L-shaped lines 62 and 64 in the alignment direction p and the distance W is set at 3.76 mm, and the lengths L1 and L2 of the L-shaped lines 62 and 64 in the alignment direction p are set at about ¼ of the wavelength λ. A result of the simulation of the second embodiment shown in FIGS. 8(A) and 8(B) are as follows. The reflection coefficient S11 shows a value of about −18 dB near the central frequency f and shows 0 dB at about 29.0 GHz or lower and at about 30 GHz or higher (see FIG. 8(A)), and the transmission coefficient S21 shows about 0 dB at the central frequency f and about −25 dB at 27.5 GHz and −30 dB at about 31.5 GHz or higher (see FIG. 8(B)), and shows a filter characteristic of a band-pass type. As is apparent from the simulation result for this second embodiment, in case of the construction provided with the first and second L-shaped lines 62 and 64, a microwave signal resonance occurs between the above-mentioned short-circuited positions ρ and σ and the microwave signal passes through the gap 60 without being reflected by the gap 60, and the microstrip lines 42 and 44 are coupled with each other electromagnetically, namely, at high frequency.

As described above, the construction of this second embodiment is a construction using no mechanical bridging means such as a wire or the like in order to couple the microstrip lines together distributed constant lines at high frequency. Therefore, since there is no problem of an inductance caused by a mechanical bridging member such as a wire, these microstrip lines can be coupled at high frequency and a signal propagation characteristic at such a high frequency as a millimetric wave is improved.

Figure 10:
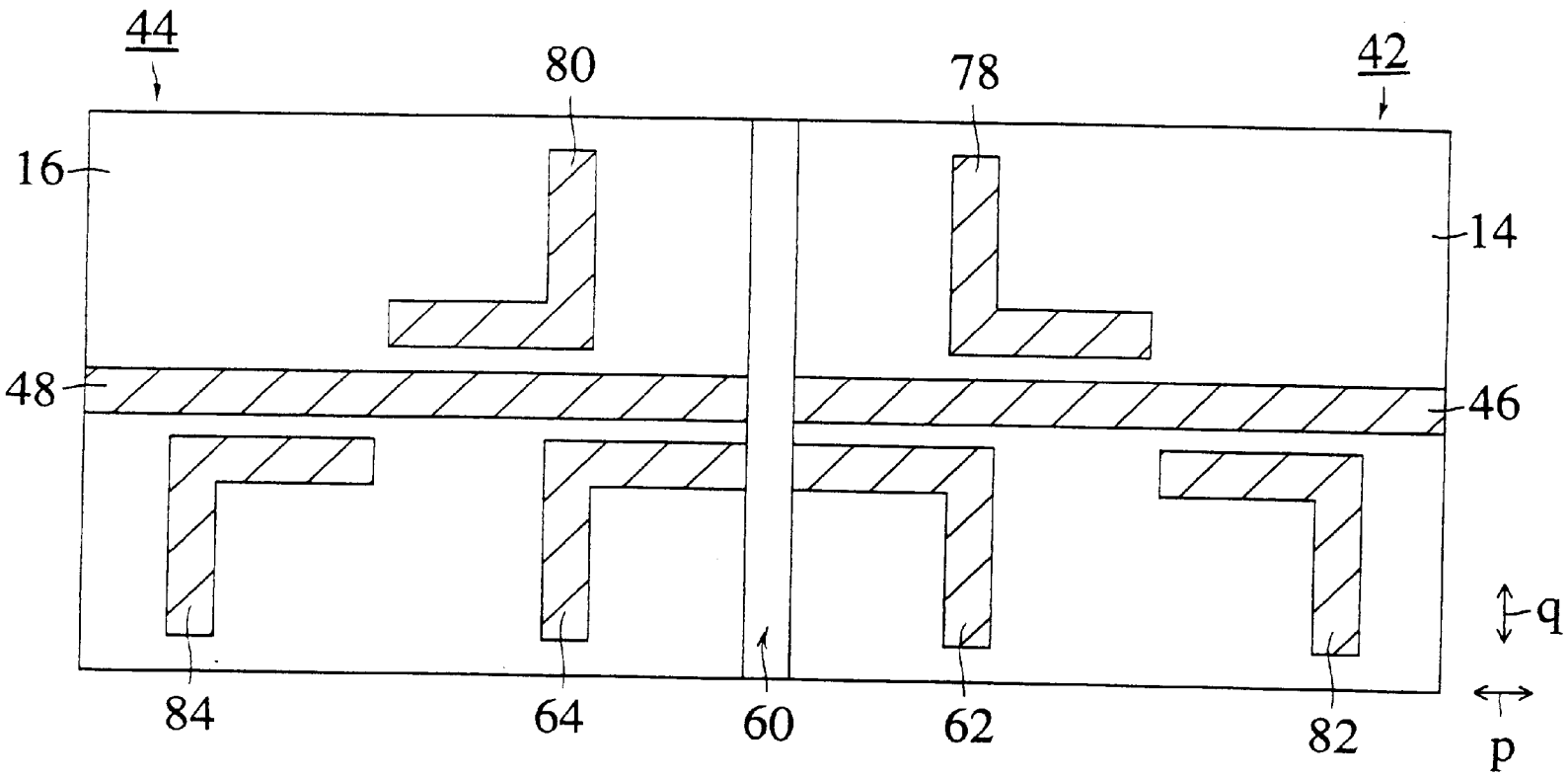
FIG. 10 is a plan view showing a variation of the second embodiment.
Figure 11:
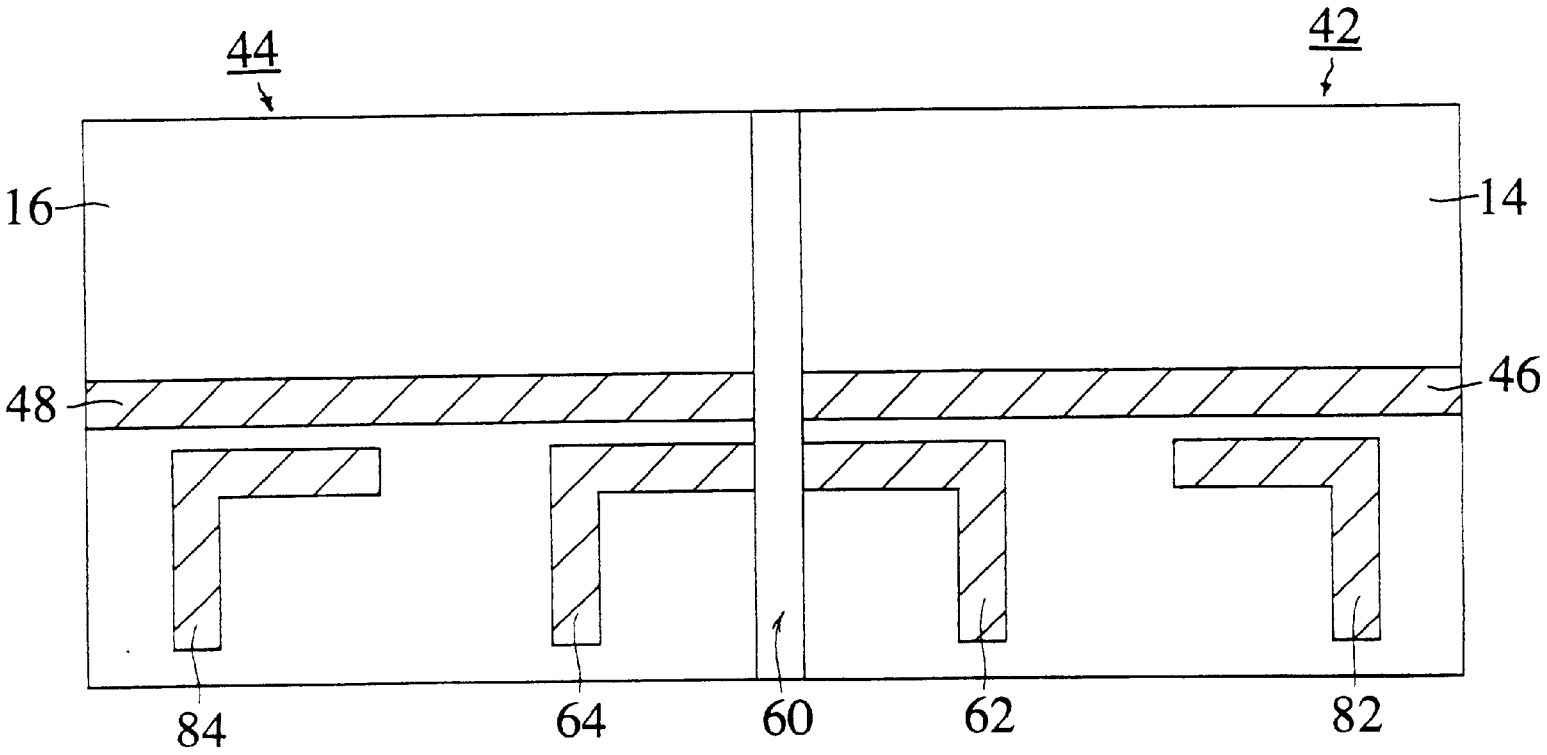
FIG. 11 is a plan view showing another variation of the second embodiment.

Although in this embodiment each of the first and second microstrip lines 42 and 44 is provided with one L-shaped line, it may be provided with two or more L-shaped lines in place of one L-shaped line. FIG. 10 shows a plan view of a variation of the second embodiment, in which each of the first and second microstrip lines 42 and 44 is provided with three L-shaped lines. FIG. 11 shows a plan view of another variation, of the second embodiment, in which each of the first and second microstrip lines 42 and 44 is provided with two L-shaped lines. In FIGS. 10 and 11, L-shaped lines and conductor lines are shown by cross-hatching.

In the construction of the variation of FIG. 10, the first microstrip line 42 is provided with the first, third, and fifth L-shaped lines 62, 78, and 82, and the second microstrip line 44 is provided with the second, fourth, and sixth L-shaped lines 64, 80, and 84. The length of each L-shaped line in the alignment direction p and the length of each L-shaped line in the direction q perpendicular to the alignment direction p are each set at λ/4. The third L-shaped line 78 is provided on the first dielectric substrate 14 at the side opposite to the first L-shaped line 62 with the first conductor line 46 interposed between them, and the first and third L-shaped lines 62 and 78 are arranged so that the positions (L-shaped corner portions) where the first and third L-shaped lines 62 and 78, respectively, are short-circuited may be at a distance of λ/4 from the gap domain 60 in the alignment direction p. The fifth L-shaped line 82 is arranged so that the line position where the fifth L-shaped line 82 is short-circuited, may be at a distance of 3λ/4 from the gap domain 60 in the alignment direction p.

On the other hand, the fourth L-shaped line 80 is provided on the second dielectric substrate 16 at the opposite side to the second L-shaped line 64 with the second conductor line 48 interposed between them, and the second and fourth L-shaped lines 64 and 80 are arranged so that the positions where the second and fourth L-shaped lines 64 and 80, respectively, are short-circuited may be at a distance of λ/4 from the gap domain 60 in the alignment direction p. And the sixth L-shaped line 84 is arranged so that the line position where the sixth L-shaped line 84 is short-circuited, may be at a distance of 3 λ/4 from the gap domain 60 in the alignment direction p. In such a way, each L-shaped line is arranged so that the line position at which each L-shaped line is short-circuited, may be at a distance equal to an odd-number times λ/4 from the gap domain 60 in the alignment direction p. The variation shown in FIG. 11 is a construction obtained by removing the third L-shaped line 78 and the fourth L-shaped line 80 from the construction shown in FIG. 10. The construction of these examples may attain the same effect as those of the second embodiment shown in FIGS. 6 and 7.

Figure 12:
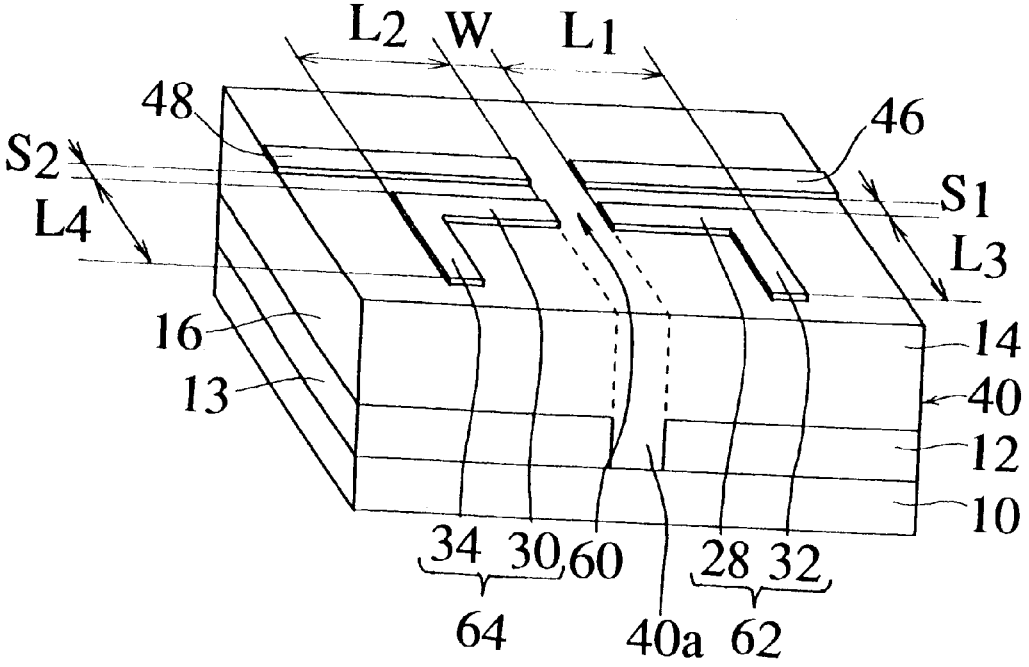
FIG. 12 is a perspective view showing still another construction of the second embodiment.

FIG. 12 is a perspective view for showing still other construction of the second embodiment. This other construction of the second embodiment is a construction having the gap domain 60 filled with a dielectric material. The first and second dielectric substrates 14 and 16 of the second construction are formed into a single dielectric substrate 40 as one continuous and solid body with the same dielectric material as these dielectric substrates. Since an electrostatic capacity between the microstrip lines 42 and 44 can be increased by filling the gap domain 60 with a dielectric material layer 40*a*, a coupling between these microstrip lines 42 and 44 can be further strengthened. A dielectric material to fill the gap 60 does not have to be the same as the material of the first and second dielectric substrates, but may be another dielectric material. For example, epoxy resin or the like can be used as the dielectric material.

This other construction of the second embodiment can be used as a filter formed on the dielectric substrate. As is apparent from the simulation example shown in FIGS. 8(A) and 8(B), this other construction shows a filter characteristic of a band-pass type. Accordingly, a filter of a band-pass type which has both a small size and an excellent Q characteristic or the like can be obtained by using the construction shown in FIG. 12.

For example, as is understood from the examples of the second construction shown in FIGS. 10 and 11, the bandwidth of such a band-pass filter can be adjusted by arranging plural L-shaped lines in series and changing the number of the L-shaped lines.

Third Embodiment

Next, the construction of a third embodiment of the present invention will be described with reference to FIGS. 13 to 17. Description of the portions of the construction which are the same as described in the first and second embodiments will be omitted to avoid repetitive explanations.

Figure 13:
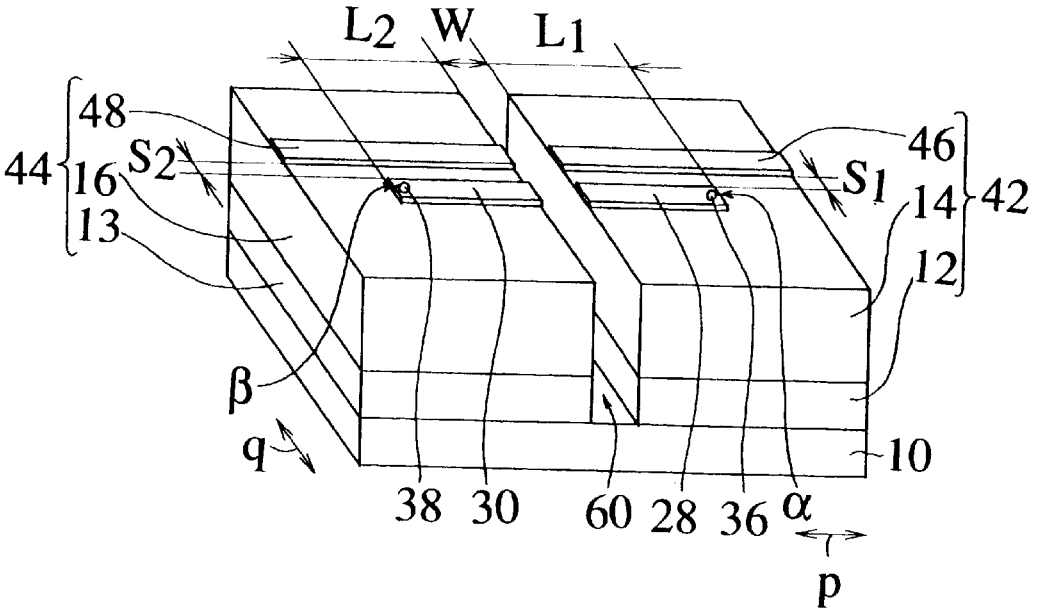
FIG. 13 is a perspective view showing a construction of a third embodiment of an apparatus used for explaining a method and an apparatus of the present invention.
Figure 14:
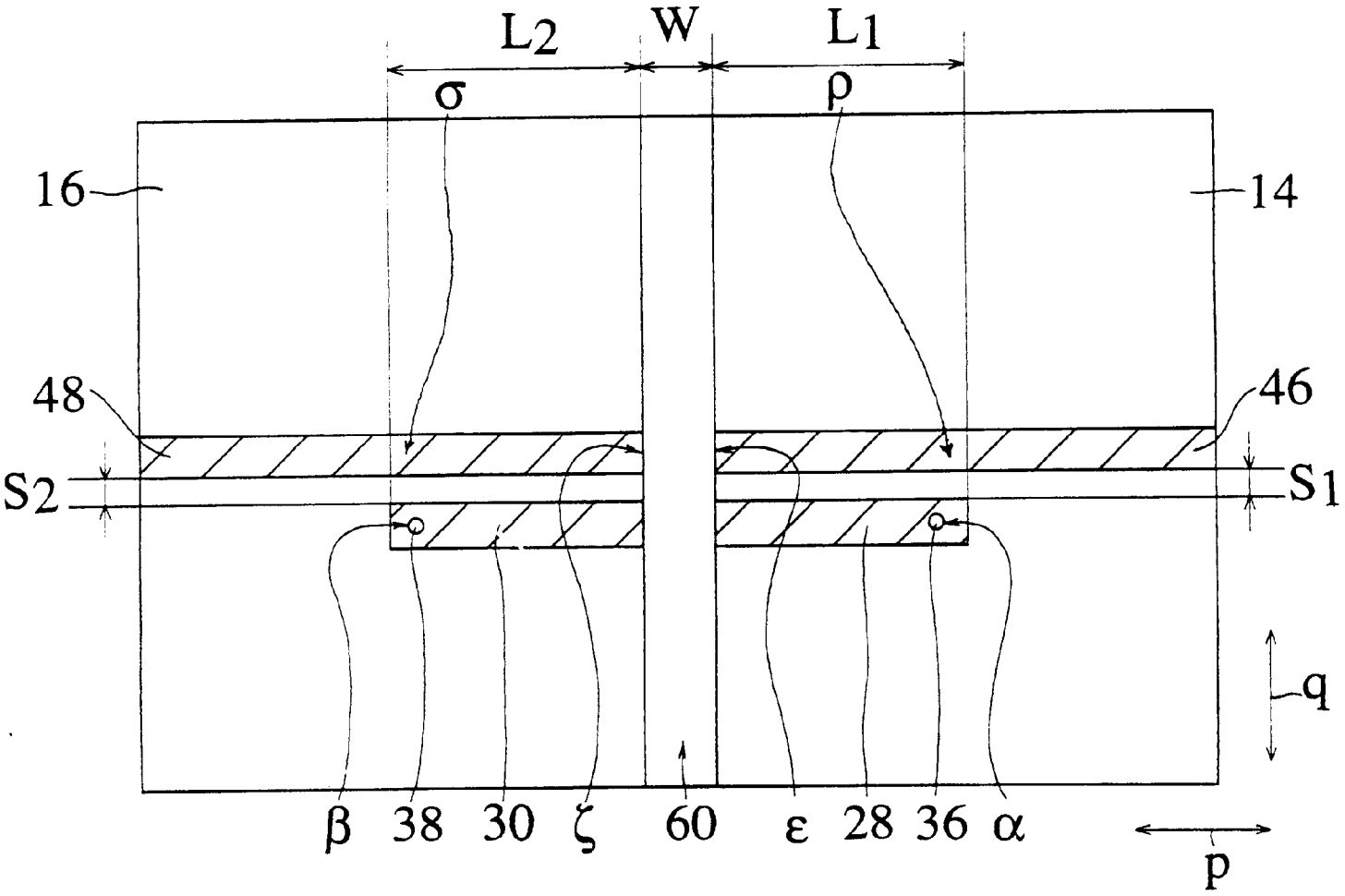
FIG. 14 is a plan view of construction of the third embodiment.

FIG. 13 is a perspective view for showing the construction of the third embodiment. FIG. 14 is a plan view for showing the construction of the third embodiment (where conductor lines and coupling conductor lines are shown by cross-hatching). In this third example of construction different from the examples shown in FIGS. 1, 4 and 5, each of the first and second conductor lines 46 and 48 is provided as an independent continuous conductor line which is rectangular quadrilateral in shape without being divided. The first and second conductor lines 46 and 48 are arranged collinear with a gap domain 60 interposed between them.

In this third example of construction, the first and second conductor lines 46 and 48 are in the shape of a rectangular parallelepiped, and the first and second conductor lines 46 and 48 are arranged so that their longitudinal direction may coincide with the alignment direction p. The first and second coupling conductor lines 28 and 30 are provided, respectively, on the first and second dielectric substrates 14 and 16 adjacently to (without being in contact with) the first and second conductor lines 46 and 48.

The first coupling conductor line 28 is a conductor line with a rectangular quadrilateral shape, which is provided on the first dielectric substrate 14, in parallel with the direction p of the first and second conductor lines 46 and 48. A first via-hole 36 is formed at the end part (a conductor line portion shown by symbol $\alpha$ in FIGS. 13 and 14) of the first coupling conductor line 28, opposite to one of the sides (the end portions shown by symbols $\epsilon$ and $\xi$ in FIG. 14) where the first and second conductor lines 46 and 48 face each other. And the second coupling conductor line 30 is a conductor line rectangular quadrilateral in shape, which is provided on the second dielectric substrate 16, in parallel with the alignment direction p, and a second via-hole 38 is formed at the end part (a conductor line portion shown by symbol $\beta$ in FIGS. 13 and 14) of the second coupling conductor line 30, opposite to the side of the ends $\epsilon$ and $\xi$.

In the third embodiment, the ends $\epsilon$ and $\xi$ of the first and second coupling conductor lines 28 and 30 are opposite to (opposing) each other with the gap domain 60 interposed between them. The third example of construction is provided with these coupling conductor lines 28 and 30, and the via-holes 36 and 38. Therefore, it is possible to couple electromagnetically, namely at high frequency, the first microstrip line 42 (composed of the first grounding conductor 12, the first dielectric substrate 14, and the first conductor line 46) and the second microstrip line 44 (composed of the second grounding conductor 13, the second dielectric substrate 16, and the second conductor line 48) as distributed constant lines.

In the third embodiment, when assuming that the wavelength corresponding to the central frequency of a desired frequency band is $\lambda$, the lengths L1 and L2 of the first and second coupling conductor lines 28 and 30 in the arrangement direction p are, respectively, set at $n\lambda/4$ (where n is a positive odd number). In the construction shown in FIGS. 13 and 14, n is selected to be 1 (n=1). Although other odd numbers 3, 5 or the like can be given as the odd number n, since it is easier to excite a wave in the dominant mode the value of n should be as low as possible. Therefore, "n=1" is the optimum.

When the first and second coupling conductor lines 28 and 30 are set in size and the first and second via-holes 36 and 38 are located at positions as described above, the length L1 of the first coupling conductor line 28 in the alignment direction p and the length L2 of the second coupling conductor line 30 in the alignment direction p are respectively set at $\lambda/4$ (in case of n=1). When the domain length of the gap domain 60, namely, the distance W along the direction p between the first and second dielectric substrates 14 and 16, is smaller than with the wavelength $\lambda$, it can be considered that the sum $(L_1+L_2+W)$ of the lengths of the first and second coupling conductor lines 28 and 30 in the direction p and the distance W is set at integer times ½ of the wavelength $\lambda$. That is to say, it is assumed that the lengths $L_1$ and $L_2$ may have an error in size so small that it does not have a substantial influence upon a desired signal propagation characteristic.

At this time, the ends $\alpha$ and $\beta$ provided with the via-holes 36 and 38 of the coupling conductor lines 28 and 30 are short-circuited. It is assumed that the distance in the direction q between the first conductor line 46 and the first coupling conductor line 28 is S1 and the distance in the direction q between the second conductor line 48 and the second coupling conductor line 30 is S2. These distances S1 and S2 are set smaller than the thickness H of the first and second dielectric substrates 14 and 16 in consideration of expansion or divergence of an electromagnetic wave. As a result, distributed couplings are made, respectively, between the conductor lines 46 and 48 and the coupling conductor lines 28 and 30, and the positions (assuming that the portions represented by symbols $\rho$ and $\sigma$ in FIG. 14 are the first line position and the second line position) of the conductor lines 46 and 48 near the short-circuited line positions $\alpha$ and $\beta$, can be short-circuited. When the distance between the first line position $\rho$ and the second line position $\sigma$, respectively, to be short-circuited of the conductor lines 46 and 48 (although the distance between $\rho$ and $\sigma$ is actually "$L_1+L_2+W$", since W is smaller in comparison with $L_1$ and $L_2$ in fact, the distance can be approximated by "$L_1+L_2$") is equal to an integer times ½ of the wavelength $\lambda$ of a microwave signal guided through the microstrip lines 42 and 44, this microwave signal can be resonated between the short-circuited line positions $\rho$ and $\sigma$. At this time, the microstrip lines 42 and 44 can be coupled with each other electromagnetically, namely, at high frequency. Therefore, since a mechanical bridging member such as a wire is not necessary for coupling the microstrip lines with each other, and an inductance is not inserted between the microstrip lines, this third example (embodiment) results in an improved in signal propagation characteristic in comparison with a conventional construction of the prior art.

In such a way, when the first line position of the first conductor line 46 (the position $\rho$ to be short-circuited) is short-circuited and the second line position of the second conductor line 48 (the position $\sigma$ to be short-circuited) is short-circuited, and the gap domain 60 is made open, and when it is assumed that the wavelength corresponding to the central frequency of a desired frequency band is $\lambda$, a microwave signal resonance can be caused between the first line position and the second line position by setting at $n\lambda/4$, respectively, the distance between the first line position and the gap domain 60 and the distance between the second line position and the gap domain 60. A standing wave of the microwave signal is formed between the first line position and the second line position by this resonance phenomenon.

Therefore, in cooperation with an effect of the underlayer metal plate 10 connecting the first grounding conductor 12 and the second grounding conductor 13 with each other, the first and second microstrip lines 42 and 44 are coupled with each other at high frequency. That is to say, these microstrip lines 42 and 44 are short-circuited at high frequency and a microwave signal can pass through the gap 60 without being reflected by the gap 60.

Figure 15A:
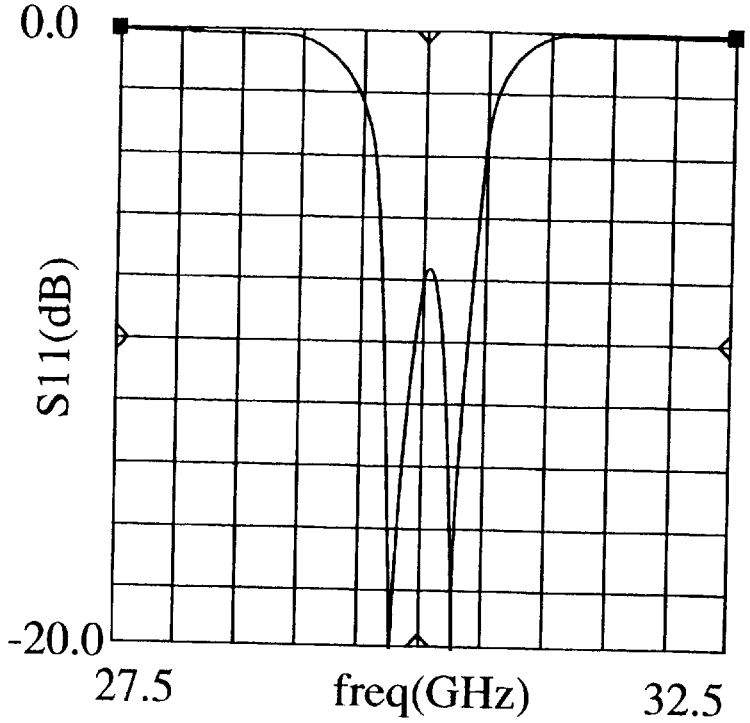
FIGS. 15(A) and 15(B) are graphs showing a result of simulation of the shown in FIGS. 13 and 14.
Figure 15B:
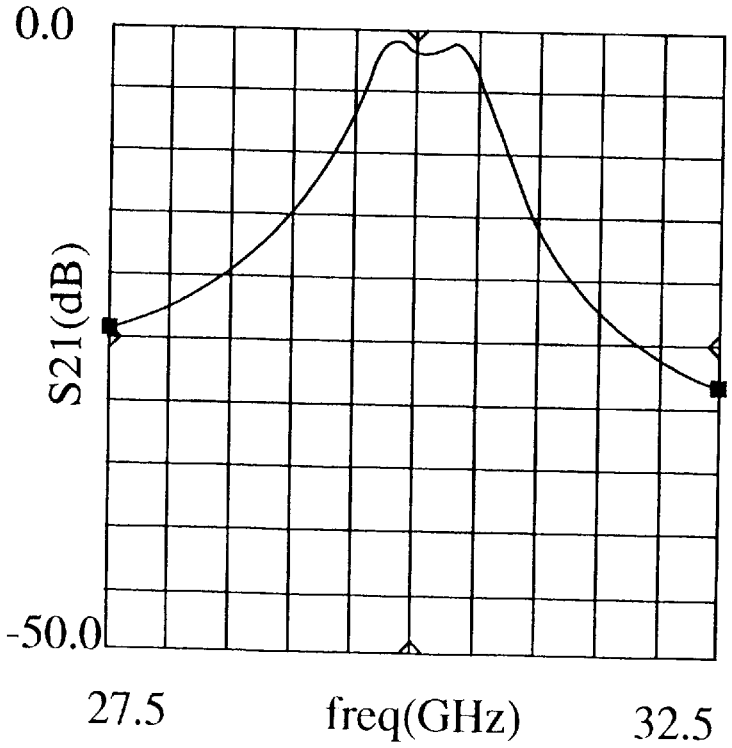
Figure 16A:
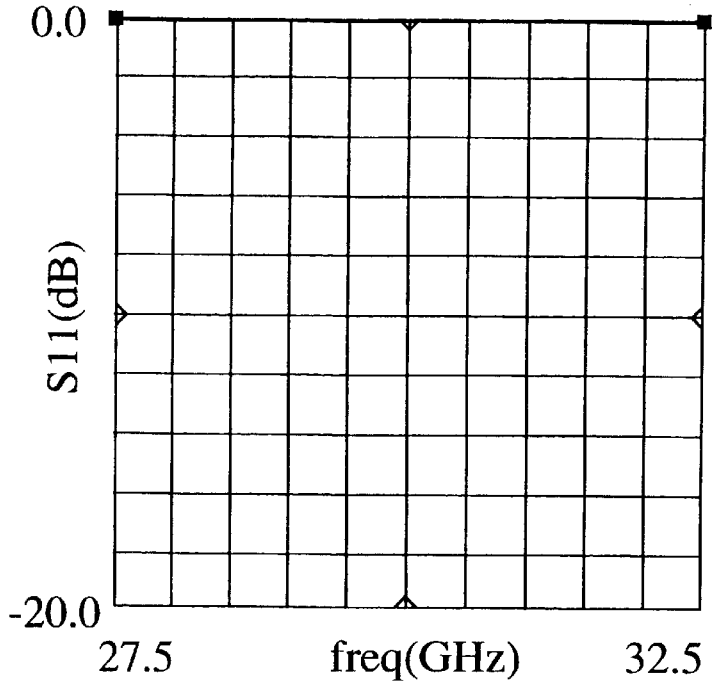
FIGS. 16(A) and 16(B) are graphs showing a result of simulation of a construction according to the prior art.
Figure 16B:
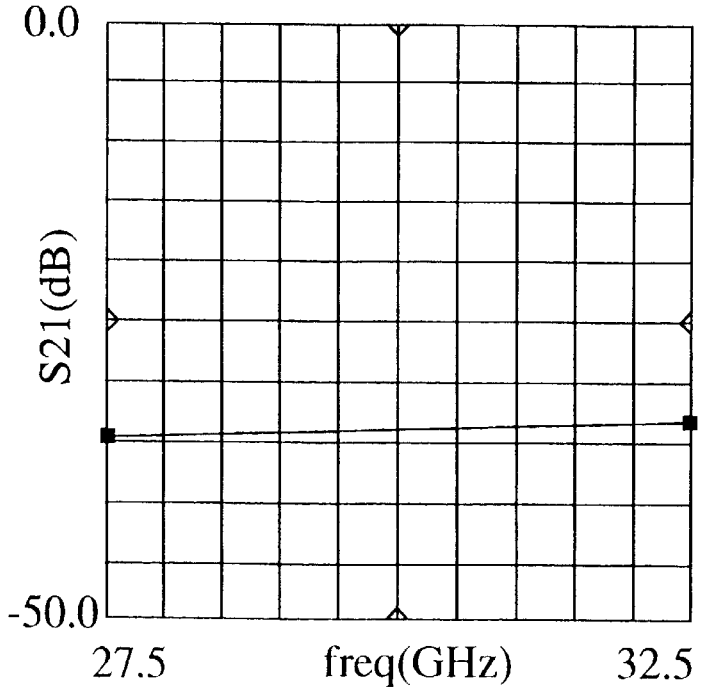

Next, operation of the third embodiment is described on the basis of result of a simulation. FIGS. 15(A) and 15(B) are graphs for showing the result of a simulation of a signal propagation characteristic of the third embodiment. FIGS. 16(A) and 16(B) are graphs for showing the result of a simulation of a signal propagation characteristic of a conventional construction for the purpose illustrated in comparison with the result of FIGS. 15(A) and 15(B). FIGS. 15(A) and 15(B) show a result in case where the third construction is provided with the first and second coupling conductor lines 28 and 30, and FIGS. 16(A) and 16(B) show a result in the case where the conventional construction is not provided with the first and second coupling conductor lines 28 and 30. In FIGS. 15(A) and 16(A), the ordinate axis represents a reflection coefficient S11 (S parameter) in a range from 0 to −20 dB (decibel), and in FIGS. 15(B) and 16(B), the ordinate axis represents a transmission coefficient S21 (S parameter) in a range from 0 to −50 dB (decibel). In each of the figures, the abscissa axis represents a frequency of a microwave in a range from 27.5 to 32.5 GHz (gigahertz).

Simulation of this embodiment has been performed in the same way as the above-described simulations of the first and second embodiments using a Microwave Design System (MDS) which is a trade name for a system manufactured by Yokogawa-Hewlett-Packard, Ltd. In this simulation, the central frequency f is set at 30 GHz (accordingly, the wavelength λ corresponding to this frequency f is about 0.8 cm in consideration of the dielectric constant of a medium in which a microwave is guided). In the case in which the first and second coupling conductor lines 28 and 30 are not provided, as shown as the result of simulation of the conventional construction example in FIGS. 16(A) and 16(B), the reflection coefficient S11 has a constant value of 0 dB over a range of measured frequencies (see FIG. 16(A)), and the transmission coefficient S21 is in a range from −32.5 dB to −35 dB over a range of measured frequencies (see FIG. 16(B)), and so it is found that a microwave is almost reflected by the gap domain 60, and the distributed constant lines are not coupled with each other.

Next, in the case of the third construction provided with the first and second coupling conductor lines 28 and 30, other constant values set in the simulation are as follows.

Thickness H of the first and second dielectric substrates 14 and 16=0.13 mm Dielectric constant of the first and second dielectric substrates 14 and 16=2.20

$L_1=L_2=1.86$ mm $S_1=S_2=0.02$ mm

W=0.1 mm

In this way, the distance ($L_1+L_2+W$) between the end α of the first coupling conductor line 28 and the end β of the second coupling conductor line 30 along the alignment direction p is set at 3.82 mm, and the lengths $L_1$ and $L_2$ of the first and second coupling conductor lines 28 and 30 along the direction p are set at about ¼ of the wavelength λ. As a result of a simulation of the third construction of FIGS. 15(A) and 15(B), the reflection coefficient S11 shows a value of about −20 dB near the central frequency f and shows 0 dB at about 29.0 GHz or lower and at about 31.0 GHz or higher (see FIG. 15(A)), and the transmission coefficient S21 shows 0 dB at the central frequency f and shows about −25 dB at 27.5 GHz and about −30 dB at 32.5 GHz (see FIG. 15(B)) and shows a filter characteristic of a band-pass type. As is apparent from the result of the simulation of this third construction, in the case of the construction provided with the first and second coupling conductor lines 28 and 30 having the first and second via-holes 36 and 38, a microwave signal is resonated between the above-mentioned short-circuited positions ρ and σ and passes through without being reflected by the gap domain 60, and the microstrip lines 42 and 44 are coupled with each other electromagnetically, namely, at high frequency.

As described above, the construction of this third embodiment is a construction using no mechanical bridging member such as a wire or the like in order to couple the microstrip lines as distributed constant lines with each other at high frequency. Therefore, since there is not a problem of an inductance caused by a mechanical bridging member such as a wire, the microstrip lines can be coupled with each other at high frequency and a signal propagation characteristic at such a high frequency as a millimetric wave is improved.

Figure 17:
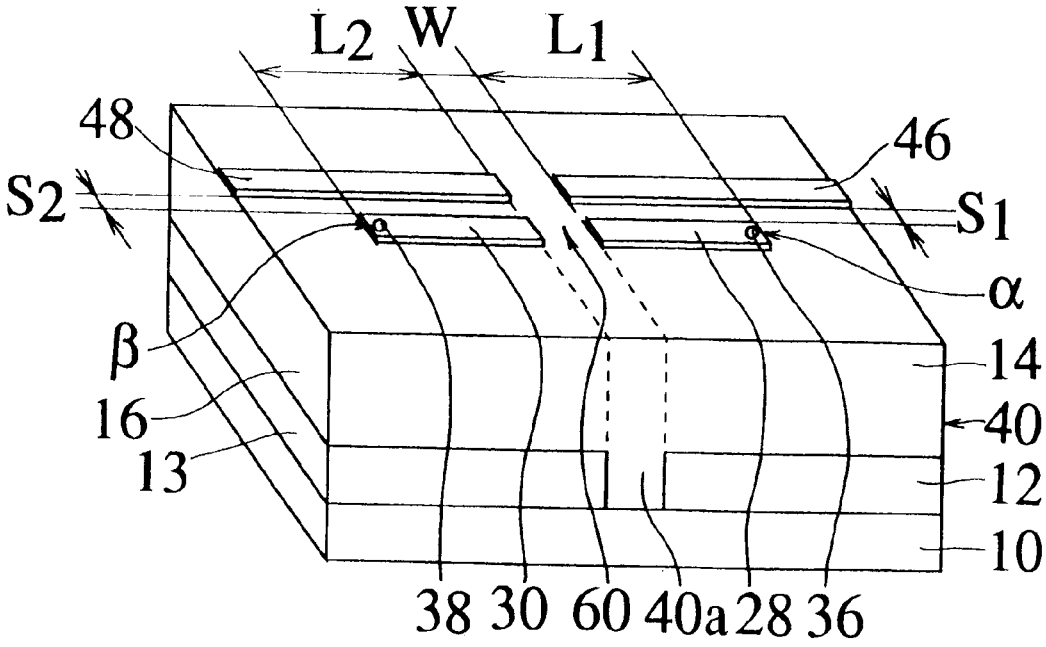
FIG. 17 is a perspective view showing another construction of the third embodiment.
Figure 18:
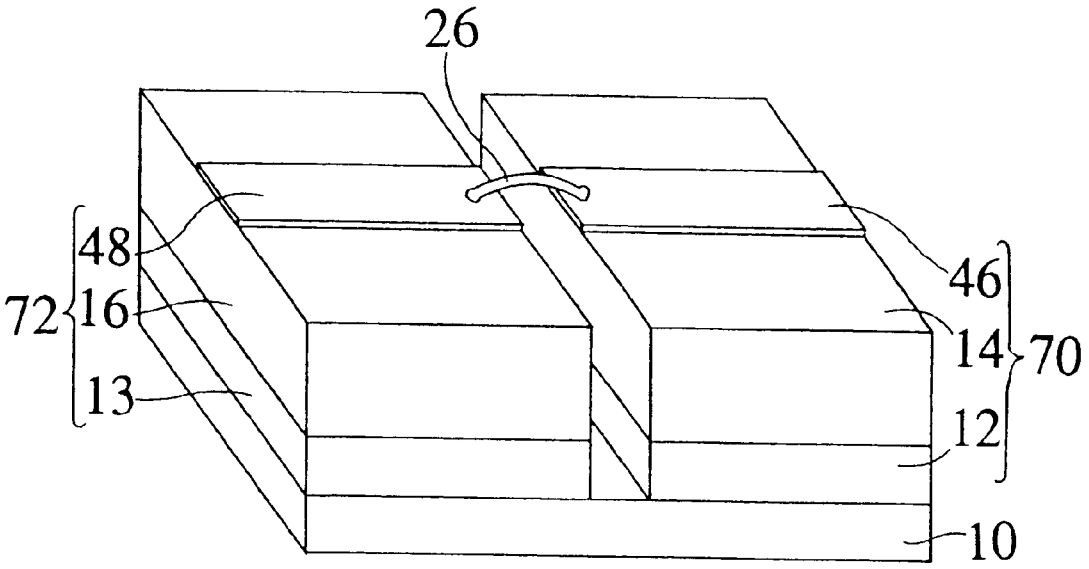
FIG. 18 is a perspective view showing a construction of the prior art.

FIG. 17 is a perspective view for showing another construction of the third embodiment. This other construction of the third constructional example is a construction having the gap domain 60 filled with a dielectric material. The first and second dielectric substrates 14 and 16 are formed into a single dielectric substrate 40 as one continuous and solid body with the same dielectric material as these dielectric substrates.

In such a way, since an electrostatic capacity between the microstrip lines 42 and 44 can be increased by filling the gap domain 60 with a dielectric material layer 40*a,* a coupling between these microstrip lines 42 and 44 can be greatly strengthened. A dielectric material to fill the gap domain 60 does not have to be the same as the material of the first and second dielectric substrates, but may be another dielectric material. For example, an epoxy resin or the like can be used as the dielectric material.

This other construction of the third embodiment can be used as a filter formed on the dielectric substrate. As shown in the simulation example of FIGS. 15(A) and 15(B), this other construction of the third embodiment shows a filter characteristic of a band-pass type. Accordingly, a filter of a band-pass type which is small in size and has an excellent Q characteristic or the like, can be obtained by using the construction shown in FIG. 17.

According to a method of coupling distributed constant lines of the present invention, it is possible to couple the first and second distributed constant lines with each other electromagnetically by arranging straightly the first and second conductor lines collinearly separately from each other with a gap domain interposed between them, in cooperation with a underlayer metal plate. Therefore, since it is not necessary to use a mechanical bridging member such as a wire or the like in order to couple distributed constant lines with each other as required in the prior art, the coupling can be accomplished without inserting an inductance between the distributed constant lines, and thus it is possible to attain a better signal propagation characteristic in comparison with the prior art.

And according to a method of coupling distributed constant lines of the present invention, a microwave signal resonance can be caused between the first and second conductor lines by making the first and second conductor lines open at specified positions. Accordingly, distributed constant lines can be coupled with each other in high frequency, and since it is not necessary to use a mechanical bridging member such as a wire or the like in order to couple the distributed constant lines with each other as required in the prior art, the coupling can be accomplished without inserting an inductance between the distributed constant lines, and thus it is possible to attain a better signal propagation characteristic in comparison with the prior art.

And according to a method of coupling distributed constant lines of the present invention, a microwave signal guided through distributed constant lines can be resonated between the first and second conductor lines by making the first and second conductor lines short-circuited at specified positions. Accordingly, the first and second distributed constant lines can be coupled with each other at high frequency, and since it is not necessary to use a mechanical bridging member such as a wire or the like in order to couple the distributed constant lines with each other as required in the prior art, the coupling can be accomplished without inserting an inductance between the distributed constant lines, and thus it is possible to attain a better signal propagation characteristic in comparison with the prior art.

And according to a method of coupling distributed constant lines of the present invention, by using a microstrip line as a distributed constant line, a microwave circuit becomes easy to integrate, and has the advantages that it has a broad-band performance, its circuit elements are easy to mount, and is little influenced by parasitic elements.

According to a microwave circuit of the present invention, an electrostatic capacity between the first and second conductor lines is made larger than that obtained with a conventional construction, by providing a gap domain between the conductor lines. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore distributed constant lines can be coupled with each other at high frequency.

According to a microwave circuit of the present invention, by providing first and second gaps respectively at specified positions of the first and second conductor lines, a standing wave which has nodes at the short-circuited line positions and an antinode at the opened position, is excited between the first and second gaps, and the first and second distributed constant lines are coupled with each other at high frequency. Therefore, since it is not necessary to connect the conductor lines with each other by means of a mechanical bridging member such as a wire or the like as in the prior art, the characteristics are not deteriorated by an inductance contained in a mechanical bridging member such as a wire, and therefore distributed constant lines can be coupled with each other at high frequency, and as a result a construction having a more excellent signal propagation characteristic than with the prior art can be attained.

And according to a microwave circuit of the present invention, by filling the gap between dielectric substrates with a dielectric material, an electrostatic capacity provided between the first and second distributed constant lines can be increased, and therefore, an electromagnetic coupling between these distributed constant lines can be made stronger. As the result, the construction having a more excellent signal propagation characteristic than with the prior art can be attained.

According to a microwave circuit of the present invention, the first and second distributed constant lines can be short-circuited at specified line positions by providing first and second L-shaped lines at specified positions of the first and second distributed constant lines. Accordingly, a standing wave which has a node at the position where each of the first and second conductor lines is short-circuited and an antinode at the gap domain where they are opened, is excited and so the first and second distributed constant lines are coupled with each other at high frequency. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore distributed constant lines can be coupled with each other at high frequency and a construction having a more excellent signal propagation characteristic than with the prior art can be attained.

According to a microwave circuit of the present invention, by filling the gap between dielectric substrates with a dielectric material, the electrostatic capacity between the first and second distributed constant lines can be increased, and therefore, an electromagnetic coupling between these distributed constant lines can be made stronger. As a result, a construction having a more excellent signal propagation characteristic than with the prior art can be attained.

And according to a microwave circuit of the present invention, the first and second conductor lines can be short-circuited (conductive) at specified positions by providing a first and a second via-hole at specified positions of a first and a second coupling conductor line, and providing the first and second coupling conductor lines at specified positions of a first and a second distributed constant line. Accordingly, a standing wave which has a node at the position where each of the first and second conductor lines is short-circuited and an antinode at the gap domain where they are opened, is excited and so the first and second distributed constant lines are coupled with each other at high frequency. Therefore, since it is not necessary to connect the conductor lines with each other by means of a mechanical bridging member such as a wire or the like as required in the prior art, the characteristics are not deteriorated by an inductance contained in a mechanical bridging member such as a wire, and therefore distributed constant lines can be coupled with each other at high frequency and a construction having a more excellent signal propagation characteristic than with the prior art can be attained.

According to a microwave circuit of the present invention, by filling the gap between dielectric substrates with a dielectric material, an electrostatic capacity between distributed constant lines forming the respective chips can be increased, and therefore, an electromagnetic coupling between these distributed constant lines can be made stronger. As a result, a construction having a more excellent signal propagation characteristic in comparison with the prior art can be attained.

And according to a microwave circuit of the present invention, by using a microstrip line as a distributed constant line, a microwave circuit becomes easy to integrate, and has advantages that it has a broad-band performance, its circuit elements, and is little influenced by parasitic elements are easy to mount.

What is claimed is:

1. A coupling of distributed constant lines, comprising:

an underlayer metal plate;

a first distributed constant line, including a first conductor line, a first dielectric substrate and a first grounding conductor; and a second distributed constant line, including a second conductor line, a second dielectric substrate and a second grounding conductor, both of said first and second distributed lines being formed on said underlayer metal plate, with said first and second grounding conductors being electrically coupled with each other through said underlayer metal plate;

wherein said first distributed constant line and said second distributed constant line are collinearly aligned with each other with a gap domain interposed therebetween so as to be electromagnetically coupled;

wherein a first line position of said first conductor line is open, a second line position of said second conductor line is open, and said gap domain is open;

wherein a first middle position between the first line position and said gap domain and a second middle position between said second line position and said gap domain are short-circuited; and wherein for a wavelength λ corresponding to a central frequency of a desired frequency band, the distance between the first line position and said gap domain and the distance between the second line position and said gap domain are each set at mλ/2 where m is an integer.

2. A coupling as claimed in claim 1, wherein:

said first conductor line comprises a first sub-line and a second sub-line arranged with a first gap interposed between them, said second conductor line comprises a third sub-line and a fourth sub-line arranged with a second gap interposed between them, and a microwave signal resonance exists between said first and second gaps.

3. A coupling as claimed in claim 1, wherein:

said first conductor line comprises plural sub-lines arranged with a first gap between one another, and said second conductor line comprises plural sub-lines arranged with a second gap between one another.

4. A coupling as claimed in claim 3, wherein:

the distance between said gap domain and the most distant gap of said first and second gaps from said gap domain is λ/2.

5. A coupling of distributed constant lines, comprising:

an underlayer metal plate;

a first distributed constant line, including a first conductor line, a first dielectric substrate and a first grounding conductor; and a second distributed constant line, including a second conductor line, a second dielectric substrate and a second grounding conductor, both of said first and second distributed lines being formed on said underlayer metal plate, with said first and second grounding conductors being electrically coupled with each other through said underlayer metal plate;

wherein said first distributed constant line and said second distributed constant line are collinearly aligned with each other with a gap domain interposed therebetween so as to be electromagnetically coupled;

wherein a first line position of said first conductor line is short-circuited, a second line position of said second conductor line is short-circuited, and said gap domain is open; and wherein for a wavelength λ corresponding to a central frequency of a desired frequency band, the distance between the first line position and said gap domain and the distance between the second line position and said gap domain are each set at nλ/4, where n is an odd number.

6. A coupling as claimed in claim 5, wherein:

said first and second distributed constant lines are microstrip lines.

7. A coupling as claimed in claim 5, wherein:

a microwave signal resonance exists between said first and second line positions.

8. A coupling as claimed in claim 5, wherein:

one or more than two first L-shaped lines are provided along said first conductor line, and one or more than two second L-shaped lines are provided along said second conductor line.

9. A coupling as claimed in claim 8, wherein said first and second L-shaped lines are short-circuited at line positions thereof which are distances λ/4, along the direction of collinear alignment of said first and second conductor lines, from said gap domain.

10. A microwave circuit comprising a first distributed constant line, a second distributed constant line and an underlayer metal plate having individually provided thereon said first and second distributed constant lines;

said first distributed constant line comprising a first dielectric substrate, a first grounding conductor provided on a first substrate lower surface of said first dielectric substrate, and a first conductor line provided on said first dielectric substrate in parallel with said first substrate lower surface;

said second distributed constant line comprising a second dielectric substrate, a second grounding conductor provided on a second substrate lower surface of said second dielectric substrate, and a second conductor line provided on said second dielectric substrate in parallel with said second substrate lower surface; and said first grounding conductor and said second grounding conductor being electrically coupled with each other through said common underlayer metal plate;

wherein said first and second conductor lines are arranged in collinear alignment with a gap domain interposed therebetween so as to cause electromagnetic coupling between said first and second distributed constant lines;

wherein said first conductor line includes a first sub-line and a second sub-line which are arranged with a first gap interposed therebetween, said first gap extending in the direction perpendicular to the direction of collinear alignment of said first and second conductor lines;

wherein said second conductor line includes a third sub-line and a fourth sub-line which are arranged with a second gap interposed therebetween, said second gap extending in the direction perpendicular to the direction of collinear alignment of said first and second conductor lines; and wherein designating the wavelength corresponding to the central frequency of a desired frequency band to be λ, the distance along said direction of collinear alignment between said first gap and said gap domain and the distance along said direction of collinear alignment between said second gap and said gap domain are each set at mλ/2 (where m is a positive integer).

11. A microwave circuit as claimed in claim 10, wherein:

said gap domain is filled with a dielectric material.

12. A microwave circuit as claimed in claim 10, wherein the length $W_3$ of said gap domain along the direction of collinear alignment is smaller than said wavelength λ and a distance $(L_1+L_2+W_3)$ is equal to the wavelength λ, where $L_1$ and $L_2$ are the respective lengths of the first sub-line and the third sub-line along the direction of collinear alignment.

13. A microwave circuit as claimed in claim 10, wherein:

the distance between said gap domain and the most distant gap of said first and second gaps from said gap domain is λ/2.

14. A microwave circuit as claimed in claim 10, wherein:

designating the length of said first gap along the direction of collinear alignment to be $W_1$, the length of said second gap along the direction of collinear alignment to be $W_2$ and the thickness of said first and second dielectric substrates to be H, then the lengths $W_1$ and $W_2$ satisfy the respective conditions "$0<W_1<H$" and "$0<W_2<H$".

15. A microwave circuit as claimed in claim 10, wherein:

the value of said m is 1, 2, or 3.

16. A microwave circuit as claimed in claim 10, wherein:

designating the length of said gap domain along the direction of collinear alignment of said first and second conductor lines to be $W_3$, and designating the thickness of each of said first and second dielectric substrates to be H, the condition "$0<W_3<H$" is satisfied.

17. A microwave circuit as claimed in claim 10, wherein:

the widths of said first, second, third, and fourth sub-lines along the direction perpendicular to the direction of collinear alignment are equal to one another.

18. A microwave circuit comprising:

a first distributed constant line, a second distributed constant line, and an underlayer metal plate having individually provided thereon said first and second distributed constant lines;

said first distributed constant line comprising a first dielectric substrate, a first grounding conductor provided on a first substrate lower surface of said first dielectric substrate, and a first conductor line provided on said first dielectric substrate in parallel with said first substrate lower surface;

said second distributed constant line comprising a second dielectric substrate, a second grounding conductor provided on a second substrate lower surface of said second dielectric substrate, and a second conductor line provided on said second dielectric substrate in parallel with said second substrate lower surface; and said first grounding conductor and said second grounding conductor being electrically coupled with each other through said underlayer metal plate;

wherein said first and second conductor lines are arranged in collinear alignment with a gap domain interposed therebetween so as to cause electromagnetic coupling between said first and second distributed constant lines;

wherein said first and second conductor lines are rectangular quadrilateral in shape;

further comprising on said first dielectric substrate a first coupling conductor line which is rectangular quadrilateral in shape and is provided in parallel with the direction of collinear alignment of said first and second conductor lines, said first coupling conductor line having a first coupling conductor end facing said gap domain and a first via-hole end opposite to said first coupling conductor end, said first via-hole end having formed therethrough a first via-hole;

further comprising on said second dielectric substrate a second coupling conductor line which is rectangular quadrilateral in shape and is provided in parallel with said direction of collinear alignment, said second coupling conductor line having a second coupling conductor end facing said gap domain and a second via-hole end opposite to said second coupling conductor end, said second via-hole end having formed therethrough a second via-hole; and wherein, designating the wavelength corresponding to the central frequency of a desired frequency band to be $\lambda$, the lengths of said first and second coupling conductor lines along said direction of collinear alignment are, respectively, equal to $n\lambda/4$ (where n is an odd number).

19. A microwave circuit as defined in claim 18, wherein:

designating the length of said gap domain along the direction of collinear alignment to be W, and the lengths of the first and second coupling conductor lines along said direction of collinear alignment to be $L_1$ and $L_2$, respectively, then W is smaller than said wavelength $\lambda$, and the distance $(L_1,+L_2+W)$ a positive-integer multiple of $\lambda/2$.

20. A microwave circuit as claimed in claim 18, wherein:

designating the distance between said first conductor line and said first coupling conductor line to be $S_1$, the distance between said second conductor line and said second coupling conductor line to be $S_2$, and a thickness of each of said first and second dielectric substrates to be H, the conditions of "$0<S_1<H$" and "$0<S_2<H$" are satisfied.

21. A microwave circuit as claimed in claim 18, wherein:

said gap domain is filled with a dielectric material.

22. A microwave circuit as claimed in claim 18, wherein:

said first and second distributed constant lines are microstrip lines.

23. A microwave circuit as claimed in claim 18, wherein:

the value of said n is 1, 3, or 5.

24. A microwave circuit comprising:

a first distributed constant line, a second distributed constant line, and an underlayer metal plate having individually provided thereon said first and second distributed constant lines;

said first distributed constant line including a first dielectric substrate, a first grounding conductor provided on a first substrate lower surface of said first dielectric substrate, and a first conductor line provided on said first dielectric substrate in parallel with said first substrate lower surface;

said second distributed constant line including a second dielectric substrate, a second grounding conductor provided on a second substrate lower surface of said second dielectric substrate, and a second conductor line provided on said second dielectric substrate in parallel with said second substrate lower surface; and said first grounding conductor and said second grounding conductor being electrically coupled with each other through said underlayer metal plate;

wherein said first and second conductor lines are arranged in collinear alignment with a gap domain interposed therebetween so as to cause electromagnetic coupling between said first and second distributed constant lines;

wherein said first and second conductor lines are rectangular quadrilateral in shape;

further comprising on said first dielectric substrate a first L-shaped line including a first coupling conductor line and a first head-opened conductor line, said first coupling conductor line being rectangular quadrilateral in shape and being provided in parallel with the direction of collinear alignment of said first and second conductor lines, and said first head-opened conductor line being rectangular quadrilateral in shape, being joined with one end of said first coupling conductor line, and extending in the direction perpendicular to said direction of collinear alignment;

further comprising on said second dielectric substrate a second L-shaped line including a second coupling conductor line and a second head-opened conductor line, said second coupling conductor line being rectangular quadrilateral in shape and being provided in parallel with said direction of collinear alignment, said second head-opened conductor line being rectangular quadrilateral in shape, being joined with one end of said second coupling conductor line, and extending in the direction perpendicular to said direction of collinear alignment; and wherein, designating the wavelength corresponding to the central frequency of a desired frequency of a desired frequency band to be λ, the lengths of said first and second L-shaped lines along said direction of collinear alignment and the lengths of said first and second L-shaped lines along the direction perpendicular to said direction of collinear alignment are, respectively, nλ/4 (wherein n is an odd number).

25. A microwave circuit as claimed in claim 24, wherein:

one or more than two of said first L-shaped lines are provided along said first conductor line, and one or more than two of said second L-shaped lines are provided along said second conductor line.

26. A microwave circuit as claimed in claim 25, wherein said first and second L-shaped lines are short-circuited at line positions thereof which are distances λ/4, along the direction of collinear alignment of said first and second conductor lines, from said gap domain.

27. A microwave circuit as claimed in claim 24, wherein:

said gap domain is filled with a dielectric material.

28. A microwave circuit as claimed in claim 24, wherein:

the value of said n is 1, 3, or 5.

29. A microwave circuit as claimed in claim 23, wherein:

designating the length of said gap domain along the direction of collinear alignment of said first dielectric substrate and said second dielectric substrate to be W and the lengths of the first and second L-shaped lines along said direction of collinear alignment to be, respectively, $L_1$ and $L_2$, W is smaller than said wavelength λ, and the distance $(L_1+L_2+W)$ is a positive-integer multiple of said wavelength λ.

30. A microwave circuit as claimed in claim 24, wherein:

designating the distance between said first conductor line and said first L-shaped line to be $S_1$, the distance between said second conductor line and said second L-shaped line to be $S_2$, and the thickness of each of said first and second dielectric substrates to be H, the conditions of "$0<S_1<H$" and "$0<S_2<H$" are satisfied.

* * * * *